US009950269B2

(12) United States Patent
Watanabe et al.

(10) Patent No.: US 9,950,269 B2
(45) Date of Patent: Apr. 24, 2018

(54) ELECTRICALLY-OPERATED TOY

(71) Applicant: Tomy Company Ltd., Tokyo (JP)

(72) Inventors: Kimitaka Watanabe, Tokyo (JP); Yoshio Suimon, Tokyo (JP)

(73) Assignee: Tomy Company Ltd., Tokyo (JP)

( * ) Notice: Subject to any disclaimer, the term of this patent is extended or adjusted under 35 U.S.C. 154(b) by 144 days.

(21) Appl. No.: 14/407,287

(22) PCT Filed: Jul. 8, 2014

(86) PCT No.: PCT/JP2014/068224
§ 371 (c)(1),
(2) Date: Dec. 11, 2014

(87) PCT Pub. No.: WO2016/006044
PCT Pub. Date: Jan. 14, 2016

(65) Prior Publication Data
US 2016/0271507 A1 Sep. 22, 2016

(51) Int. Cl.
*A63H 29/22* (2006.01)
*A63H 17/26* (2006.01)
*A63H 29/00* (2006.01)

(52) U.S. Cl.
CPC ..... *A63H 29/22* (2013.01); *A63H 17/26* (2013.01); *A63H 29/00* (2013.01)

(58) Field of Classification Search
CPC ..... A63H 17/00; A63H 29/00; A63H 29/22; A63H 17/26
See application file for complete search history.

(56) References Cited

U.S. PATENT DOCUMENTS 8,337,274 B1 * 12/2012 Wong ..... A63H 29/22 446/443
2006/0258261 A1 * 11/2006 Tse ..... A63H 17/40 446/442

(Continued)

FOREIGN PATENT DOCUMENTS

EP 3 147008 A1 3/2017
JP 1990-041982 11/1990

(Continued)

OTHER PUBLICATIONS

Translation of JP2009-153357A.*

(Continued)

*Primary Examiner* — Gene Kim
*Assistant Examiner* — Alyssa Hylinski
(74) *Attorney, Agent, or Firm* — Rutan & Tucker, LLP

(57) ABSTRACT

[Problem to be Solved] To provide an electrically-operated toy that uses an electric double-layer capacitor as a main power source and yet can secure an operation duration time per charge that is long enough to fully satisfy the users who are infants, younger school children, etc.
[Solution] Provided is an electrically-operated toy that includes: an electric double-layer capacitor acting as a main power source; a movable mechanism for realizing toy functions; an electric motive power source for operating the movable mechanism; and a chopper-type step-up DC/DC converter that boosts a voltage received from the electric double-layer capacitor and supplies the voltage as a power source to at least the electric motive power source.

15 Claims, 17 Drawing Sheets

(56) References Cited

U.S. PATENT DOCUMENTS

| | | | | |
|---|---|---|---|---|
| 2007/0007939 | A1* | 1/2007 | Miller | B60K 6/26 323/299 |
| 2010/0130096 | A1 | 5/2010 | Baarman et al. | |
| 2011/0084648 | A1* | 4/2011 | Cao | H01M 10/44 320/103 |

FOREIGN PATENT DOCUMENTS

| | | | |
|---|---|---|---|
| JP | 1992-018594 | | 2/1992 |
| JP | 1994-39148 | | 2/1994 |
| JP | 1994-31796 | | 4/1994 |
| JP | 2004-109138 | | 4/2004 |
| JP | 2009153357 | A * | 7/2009 |
| JP | 2010-93888 | | 4/2010 |
| JP | 3173871 | | 2/2012 |
| JP | 5717267 | | 3/2015 |
| KR | 20130120305 | A | 11/2014 |

OTHER PUBLICATIONS

Written Opinion of International Patent Application No. PCT/JP2014/068224, PCT/ISA/237 Form, dated Sep. 9, 2014, English translation, 2 pages. International Searching Authority/Japan.

Written Opinion of International Patent Application No. PCT/JP2014/068224, PCT/ISA/237 Form, dated Sep. 9, 2014, Untranslated copy in Japanese, 5 pages. International Searching Authority/Japan.

Supplemental European Search Report issued in copending EP Patent Application 14896992.6, dated Apr. 21, 2014, 3 pages.

* cited by examiner

ELECTRICALLY-OPERATED TOY

This patent application is a 35 U.S.C. § 371 Application of International Patent Application Number PCT/JP2014/068224, titled "ELECTRICALLY-OPERATED TOY" having an International Filing Date of Jul. 8, 2014, which is incorporated herein by reference in its entirety.

TECHNICAL FIELD

The present invention relates to an electrically-operated toy, and more particularly to an electrically-operated toy that operates using an electric double-layer capacitor as a power source.

BACKGROUND ART

Conventionally, there are known electrically-operated toys that operate using batteries as a power source (e.g., electric car toys that are movable bodies, electric rocking dolls that are non-movable bodies, etc.), some of which use primary batteries such as manganese batteries, alkaline batteries, or button-type mercury batteries as a power source, while others use rechargeable secondary batteries, as represented by nickel-cadmium batteries, as a power source.

However, those electrically-operated toys that use primary batteries as a power source have disadvantages such as that long-term use of the toy requires frequent battery changes; liquid leakage is likely to occur when the toy is left unused for a long period; the weight is relatively large; and especially button-type mercury batteries are prone to accidental swallowing by infants. On the other hand, those using secondary batteries as a power source have disadvantages, in addition to the same disadvantages of likely liquid leakage and heavy weight as with primary batteries, such as that the battery deteriorates and fails to deliver its initial performance as the number of charge cycles increases; in rare cases ignition may result from heat generation of the battery; and it takes a relatively long time to charge the battery. Therefore, there is a growing trend in the field of electrically-operated toys, whose main users are infants, younger school children, etc., toward avoiding the use of batteries as a power source, especially with the objective of securing safety.

Meanwhile, an electrically-operated toy that uses an electric double-layer capacitor (also called a super capacitor) as a power source (see Patent Document 1) is known as an electrically-operated toy that uses no batteries dependent on chemical reaction as a power source.

Patent Document 1, Japanese Utility Model Laid-Open Publication No. H04-018594 (1992-018594), is an example patent document with a super capacitor.

SUMMARY OF THE INVENTION

Figure 1:
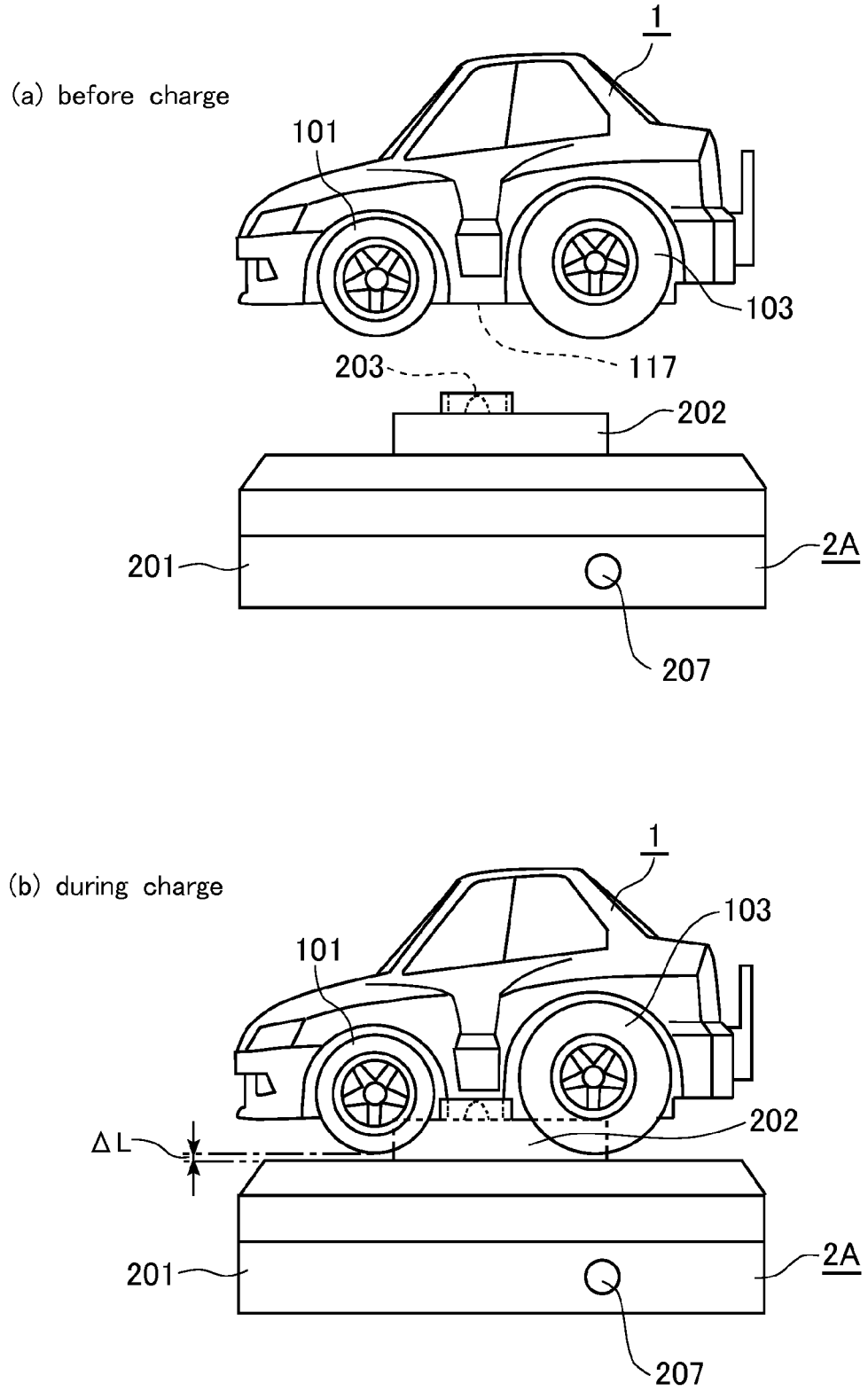
FIG. 1 is a system configuration chart showing one example of an electrically-operated car toy and its battery-type charger.

Technical Problem to be Solved by the Invention

An electric double-layer capacitor has advantages such as light weight, fast charge capability, and resistance to deterioration due to repeated charge cycles. However, on the assumption of a power supply to a motive power source (electric motor etc.) for operating a movable mechanism that realizes toy functions, unless an electric double-layer capacitor of exceptionally large electrostatic capacity is adopted, due to a rapid decrease of the voltage of the electric double-layer capacitor, the operation duration time per charge is too short to fully satisfy the users who are infants, younger school children, etc.

Especially in an electrically-operated toy that has not only a motive power source for operating the movable mechanism but also a control circuit (e.g., a microprocessor and its peripheral circuit, etc.) for controlling the operation of the motive power source as loads of the electric double-layer capacitor serving as a power source, once the voltage of the electric double-layer capacitor has decreased to the operable power source voltage of the control circuit, the electrically-operated toy stops operation due to inoperability of the control circuit despite the sufficient electric charge still remaining in the electric double-layer capacitor.

In fact, if an electrically-operated toy with a control circuit equivalent to a load of about 30 to 50 mA is designed using a lower-capacity electric double-layer capacitor (e.g., about 1 to 3 F) as a main power source with the intention of reducing the size and cost, the operation duration time (e.g., corresponding to a travel duration time for a small toy car such as an electrically-operated minicar) is as short as about 5 to 10 seconds, which can hardly satisfy the users, infants and younger school children as they are.

Therefore, as shown in Patent Document 1, when an electric double-layer capacitor is used as a power source of an electrically-operated toy, it is a common practice to use the electric double-layer capacitor as an auxiliary power source and separately use some form of other power generation means (e.g., solar batteries) as a main power source.

The present invention has been made in view of the above-described problems, and a purpose of the present invention is to provide an electrically-operated toy that uses an electric double-layer capacitor as a main power source and yet can secure an operation duration time per charge that is long enough to fully satisfy the users who are infants, younger school children, etc.

Those skilled in the art would easily understand other purposes and advantages of the present invention by referring to the following description of this specification.

Solution to Problem

In order to solve the above-described problems, an electrically-operated toy and a computer program of the present invention are configured as follows.

That is, the electrically-operated toy of the present invention includes: an electric double-layer capacitor serving as a main power source; a movable mechanism for realizing functions as the toy; an electric motive power source for operating the movable mechanism; and a chopper-type step-up DC/DC converter that boosts a voltage received from the electric double-layer capacitor and supplies the voltage to at least the electric motive power source as a power source.

According to the electrically-operated toy of such configuration, since the chopper-type step-up DC/DC converter, which boosts a voltage received from the electric double-layer capacitor serving as a main power source and supplies the voltage as a power source to at least the electric motive power source for operating the movable mechanism, is interposed between the electric double-layer capacitor and the electric motive power source, the power source utilization rate is significantly improved and electric charge charged in the electric double-layer capacitor can be thoroughly used. Thus, it is possible to use an electric double-layer capacitor as a main power source and yet to secure an operation duration time per charge that is long enough to fully satisfy the users who are infants, younger school children, etc.

In a preferred embodiment of the electrically-operated toy according to the present invention, the electrically-operated toy may further comprise a control circuit for controlling the operation of the electric motive power source; the chopper-type step-up DC/DC converter may be adapted to boost a voltage received from the electric double-layer capacitor and supply the voltage boosted to the control circuit as a power source thereof; and the step-up type DC/DC converter may further have a constant voltage output function, and have a minimum operable input voltage that is lower than a power source voltage required for actuation of the control circuit and a constant output voltage that is higher than the power source voltage required for actuation of the control circuit.

According to the electrically-operated toy of such configuration, even when the voltage of the electric double-layer capacitor decreases below the power source voltage required for actuation of the control circuit, until the voltage falls to the minimum operable input voltage of the DC/DC converter (which is determined, e.g., by an input threshold voltage etc. of a transistor element used), the constant output voltage higher than the power source voltage required for actuation of the control circuit can be supplied to the control circuit. Thus, it is possible to secure an operation duration time per charge that is long enough to fully satisfy the users who are infants, younger school children, etc. by extending the operable period of the control circuit.

In a preferred embodiment of the electrically-operated toy according to the present invention, the electrically-operated toy may further include a power switch for turning on and off the power supply to the control circuit, and a discharge path that short-circuits a power source line on the output side of the DC/DC converter when the power switch is off to thereby zero-reset the voltage applied to the control circuit.

According to the electrically-operated toy of such configuration, it is possible to use an electric double-layer capacitor as a main power source and yet to secure a sufficient operation duration time. Moreover, it is possible to reliably actuate a power-on reset function of a microprocessor included in the control circuit upon power on and to normally start any given program.

In a preferred embodiment of the electrically-operated toy according to the present invention, the control circuit may include a microprocessor serving as a CPU, and the microprocessor may have a built-in function of forcibly terminating program execution upon detecting that the output voltage of the DC/DC converter has fallen to a predetermined voltage that is preset as a value immediately before a rapid fall toward zero volts.

According to the electrically-operated toy of such configuration, it is possible to use an electric double-layer capacitor as a main power source and yet to secure a sufficient operation duration time per charge. Moreover, it is possible to prevent malfunction of the microprocessor caused by a rapid decrease in the output voltage of the DC/DC converter due to the charging voltage of the electric double-layer capacitor decreasing to the minimum operation voltage of the DC/DC converter.

In a preferred embodiment of the electrically-operated toy according to the present invention, the control circuit may include a microprocessor serving as a CPU, and the microprocessor may have a built-in function of detecting the charging voltage of the electric double-layer capacitor and changing a set output voltage value of the DC/DC converter according to the detected value.

According to the electrically-operated toy of such configuration, it is possible to use an electric double-layer capacitor as a power source and yet to secure a sufficient operation duration time. Moreover, it is possible, for example, to realize a power saving function by automatically changing the output voltage of the double-layer capacitor upon the charging voltage of the electric double-layer capacitor reaching a predetermined voltage.

In a preferred embodiment of the electrically-operated toy according to the present invention, the movable mechanism may be a front-wheel steering mechanism and a rear-wheel rotating mechanism for realizing car toy functions; the electric motive power source may be a steering drive source for operating the front-wheel steering mechanism and a rear-wheel electric motor for operating the rear-wheel rotating mechanism; and the control circuit may have a function of controlling the steering drive source and the rear-wheel electric motor according to a given control command.

According to the electrically-operated car toy of such configuration, even when the voltage of the electric double-layer capacitor decreases below the power source voltage required for actuation of the control circuit, until the voltage falls to the minimum operable input voltage of the DC/DC converter, the constant output voltage higher than the power source voltage required for actuation of the control circuit can be supplied to the control circuit. Thus, it is possible to secure a travel duration time per charge that is long enough to fully satisfy the users who are infants, younger school children, etc. by extending the operable period of the control circuit.

In a preferred embodiment of the electrically-operated car toy according to the present invention, the control circuit may include a microprocessor serving as a CPU, the microprocessor having at least built-in functions of power-on reset and of controlling at least the steering drive source and the rear-wheel electric motor by decoding and executing a given control command; and the electrically-operated car may further have a power switch for turning on and off the power supply to the control circuit, and a short-circuit line that short-circuits the power source line on the output side of the DC/DC converter when the power switch is off to thereby zero-reset the voltage applied to the control circuit.

According to the electrically-operated car toy of such configuration, it is possible to use an electric double-layer capacitor as a main power source and yet to secure a sufficient travel duration time. Moreover, it is possible to reliably actuate the power-on reset function of the microprocessor included in the control circuit upon power on and to normally start any given program.

In a preferred embodiment of the electrically-operated car toy according to the present invention, the microprocessor may further have a built-in function of forcibly terminating program execution upon detecting that the output voltage of the DC/DC converter has fallen to a predetermined voltage that is preset as a value immediately before a rapid fall toward zero volts.

According to the electrically-operated car toy of such configuration, it is possible to use an electric double-layer capacitor as a main power source and yet to secure a sufficient travel duration time. Moreover, it is possible to prevent malfunction of the microprocessor caused by a rapid decrease in the output voltage of the DC/DC converter due to the charging voltage of the electric double-layer capacitor decreasing to the minimum operation voltage of the DC/DC converter.

In a preferred embodiment of the electrically-operated car toy according to the present invention, the microprocessor may further have a built-in function of detecting the charging voltage of the electric double-layer capacitor and changing the set output voltage value of the DC/DC converter according to the detected value.

According to the electrically-operated car toy of such configuration, it is possible to use an electric double-layer capacitor as a power source and yet to secure a sufficient travel duration time. Moreover, it is possible, for example, to realize a power saving function by automatically changing the output voltage of the double-layer capacitor upon the charging voltage of the electric double-layer capacitor reaching a predetermined voltage.

In a preferred embodiment of the electrically-operated car toy according to the present invention, which has the microprocessor with the built-in functions of control command decoding/execution and of power-on reset and which has also the power switch and the short-circuit line, the microprocessor may further have built-in functions of setting the current flowing through the rear-wheel electric motor by applying a voltage pulse train to the rear-wheel electric motor, and of reducing the current flowing through the rear-wheel electric motor by changing the pulse width, pulse frequency, and/or duty ratio of the pulse train when the given control command is an energy saving command.

According to the electrically-operated car toy of such configuration, it is possible to use an electric double-layer capacitor as a main power source and yet to secure a sufficient travel duration time. Moreover, it is possible to provide an electrically-operated car toy that guarantees reliable execution of the power-on reset function upon power on and yet is capable of energy-saving travel when an energy saving command is given to the toy at any given point in time.

In a preferred embodiment of the above-described series of electrically-operated car toys according to the present invention, the control circuit may further include a reception demodulation IC that receives and demodulates a control command wirelessly sent by a predetermined modulation method and gives the control command to the microprocessor, and the microprocessor may be adapted to receive the control command wirelessly sent from a predetermined remote controller through the reception demodulation IC and decode and execute the control command.

According to the electrically-operated car toy of such configuration, it is possible to use an electric double-layer capacitor as a main power source and yet to secure a sufficient travel duration time. Moreover, it is possible to steer the toy through remote manipulation.

In a preferred embodiment of the electrically-operated toy according to the present invention, the electrically-operated toy may comprise a charger that can be attached to and detached from the electrically-operated toy and can charge the electric double-layer capacitor embedded in the electrically-operated toy.

According to the electrically-operated toy of such configuration, it is possible to provide an electrically-operated toy that uses an electric double-layer capacitor as a main power source and yet can secure a sufficient operation duration time, and moreover is easy to manipulate.

In a preferred embodiment of the electrically-operated toy according to the present invention, the charger may include: a pair of power supply terminals to be connected with a pair of power reception terminals on the electrically-operated toy side; a charging power source unit that is composed of one or more batteries and has an output voltage that is set to be substantially equal to a target charging voltage; a resistor that is placed on a path leading from the charging power source unit to the power supply terminals and limits the charging current flowing into the electric double-layer capacitor; and an indicator lamp that lights only during a period in which there is electrical continuity between the pair of power supply terminals and the pair of power reception terminals and at the same time the voltage across the pair of power supply terminals rises to the target charging voltage.

According to the electrically-operated toy of such configuration, it is possible to use an electric double-layer capacitor as a main power source and yet to secure a sufficient operation duration time. Moreover, it is possible, when charging the toy, to automatically complete the charge at a proper charging current by simply mounting the toy on the charger and to easily confirm the completion of the charge with lighting of the indicator lamp.

In a preferred embodiment of the electrically-operated toy according to the present invention, the charger may include: a pair of power supply terminals to be connected with a pair of power reception terminals on the electrically-operated toy side; a charging power source unit being composed of a manual power generator and outputs a DC voltage; and a smoothing and stabilizing circuit that smoothes a voltage obtained from the charging power source unit and stabilizes the voltage to a target charging voltage.

According to the electrically-operated toy of such configuration, it is possible to use an electric double-layer capacitor as a main power source and yet to secure a sufficient operation duration time, and moreover to eliminate the need for batteries to charge the toy.

In a preferred embodiment of the electrically-operated car toy according to the present invention, the electrically-operated car toy may have a charger that can be attached to and detached from the electrically-operated toy and can charge the electric double-layer capacitor embedded in the electrically-operated car toy.

According to the electrically-operated car toy of such configuration, it is possible to use an electric double-layer capacitor as a main power source and yet to secure a sufficient operation duration time. Moreover, it is possible, when charging the toy, to automatically complete the charge at a proper charging current by simply mounting the toy on the charger and to easily confirm the completion of the charge with lighting of the indicator lamp.

In a preferred embodiment of the electrically-operated car toy according to the present invention, the charger may include: a pair of power supply terminals to be connected with a pair of power reception terminals on the car toy side constituting the electrically-operated toy; a charging power source unit being composed of one or more batteries and having an output voltage that is set to be substantially equal to a target charging voltage; a resistor that is placed on a path leading from the charging power source unit to the power supply terminals and limits the charging current flowing into the electric double-layer capacitor; and an indicator lamp that lights only during a period in which there is electrical continuity between the pair of power supply terminals and the pair of power reception terminals and at the same time the voltage across the pair of power supply terminals rises to the target charging voltage, and the pair of power supply terminals may be configured as a power supply terminal receptacle or a power supply terminal plug that is provided on an external surface of a casing of the charger and that is plug-connected with a pair of power reception terminal plugs or power reception terminal receptacles provided on the bottom of the car body of the car toy in a state where the rear wheels of the car toy are lifted.

According to the electrically-operated car toy of such configuration, it is possible to use an electric double-layer capacitor as a main power source and yet to secure a sufficient travel duration time. Moreover, it is possible, when charging the toy, to complete the charge at a proper charging current by simply mounting the toy directly on the casing of the charger through the plug and the receptacle without using an electric cord, and to easily confirm the completion of the charge with lighting of the indicator lamp. Furthermore, it is unlikely that the charger falls out of the casing due to inadvertent rotary driving or steering driving of the wheels caused by erroneous manipulation during charge.

In a preferred embodiment of the electrically-operated car toy according to the present invention, the charger may include: a pair of power supply terminals to be connected with a pair of power reception terminals on the electrically-operated toy side; a charging power source unit that is composed of a manual power generator and outputs a DC voltage; a smoothing and stabilizing circuit that smoothes a voltage obtained from the charging power source unit and stabilizes the voltage to a target charging voltage; and the pair of power supply terminals may be configured as a power supply terminal recessed part or a power supply terminal protrusion part that is provided on an external surface of a casing of the hand-held charger and that is plug-connected with a pair of power reception terminal protrusion parts or power reception terminal recessed parts provided on the bottom of the car body of the car toy in a state where the rear wheels of the car toy are lifted.

According to the electrically-operated car toy of such configuration, it is possible to use an electric double-layer capacitor as a main power source and yet to secure a sufficient operation duration time. Moreover, it is possible, when charging the toy, to automatically complete the charge at a proper charging current through manual operation of the power generator by simply mounting the toy directly on the casing of the charger through the plug and the receptacle without using an electric cord. Furthermore, it is unlikely that the charger falls out of the casing due to inadvertent rotary driving or steering driving of the wheels caused by erroneous manipulation during charge.

When seen from another aspect, the present invention can be also understood as a computer program for an electrically-operated toy that includes: an electric double-layer capacitor serving as a main power source; a movable mechanism for realizing functions as the toy; an electric motive power source for operating the movable mechanism; a control circuit for controlling the operation of the electric motive power source; and a step-up DC/DC converter that boosts a voltage received from the electric double-layer capacitor and supplies the voltage as a power source to at least the control circuit, wherein the computer program causes a microprocessor included in the control circuit to function so as to forcibly terminate program execution upon detecting that the output voltage of the DC/DC converter has fallen to a predetermined voltage that is preset as a value immediately before a rapid fall to zero volts.

According to a computer program of such configuration, it is possible to use an electric double-layer capacitor as a main power source and yet to secure a sufficient operation duration time by incorporating the computer program into the microprocessor configuring the control circuit. Moreover, it is possible to realize an electrically-operated toy that can reliably actuate the power-on reset function of the microprocessor included in the control circuit upon power on and normally start any given program.

Advantageous Effects of the Invention

According to the electrically-operated toy of the present invention, the power source utilization rate is significantly improved and electric charge charged in the electric double-layer capacitor can be thoroughly used. Thus, it is possible to use an electric double-layer capacitor as a main power source and yet to secure an operation duration time per charge that is long enough to fully satisfy the users who are infants, younger school children, etc.

BRIEF DESCRIPTION OF DRAWINGS

FIG. 1 is a system configuration chart showing one example of an electrically-operated car toy and its battery-type charger.

Figure 2:
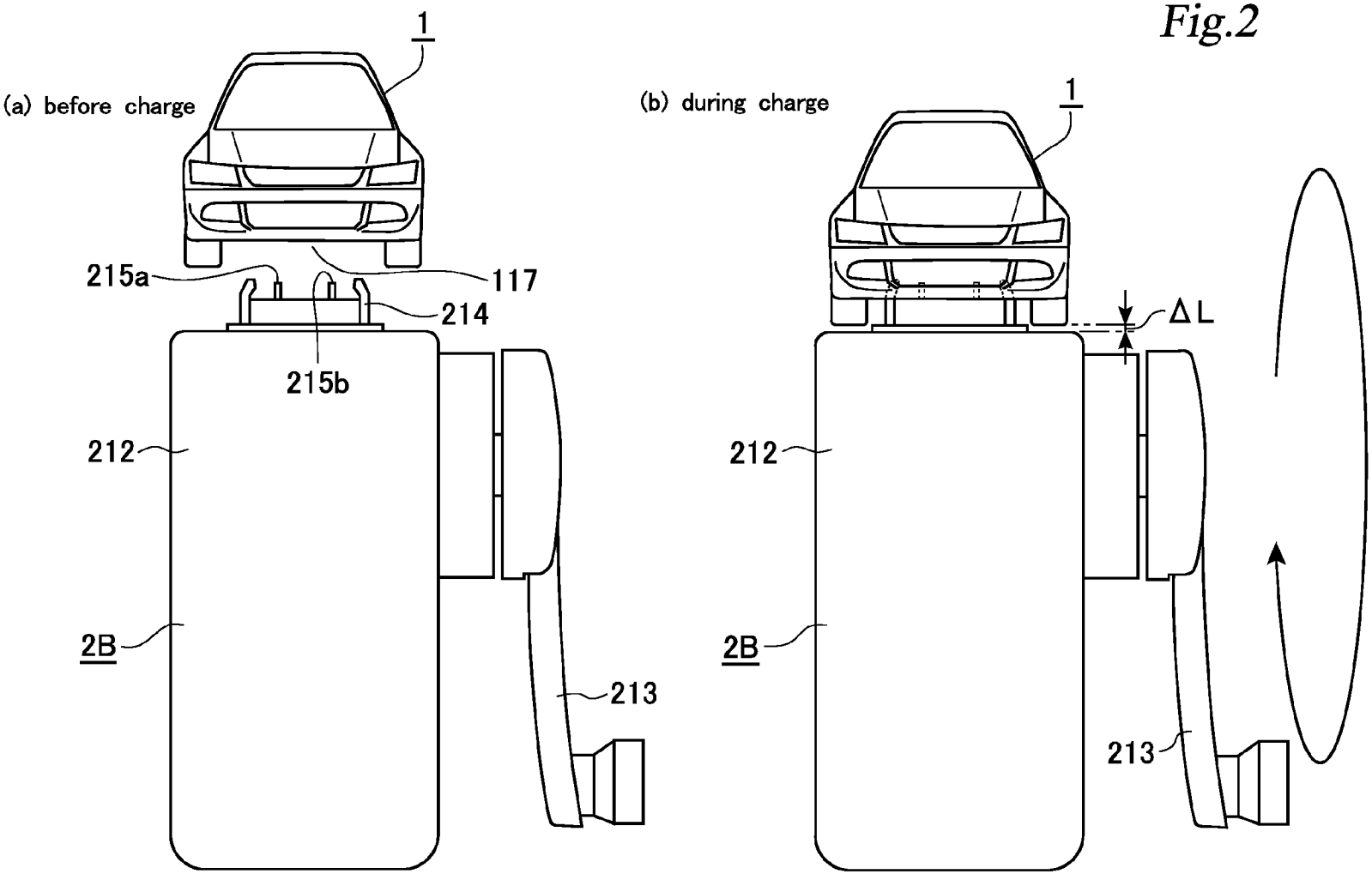
FIG. 2 is a system configuration chart showing one example of an electrically-operated car toy and its hand power generation-type charger.

FIG. 2 is a system configuration chart showing one example of an electrically-operated car toy and its hand power generation-type charger.

Figure 3:
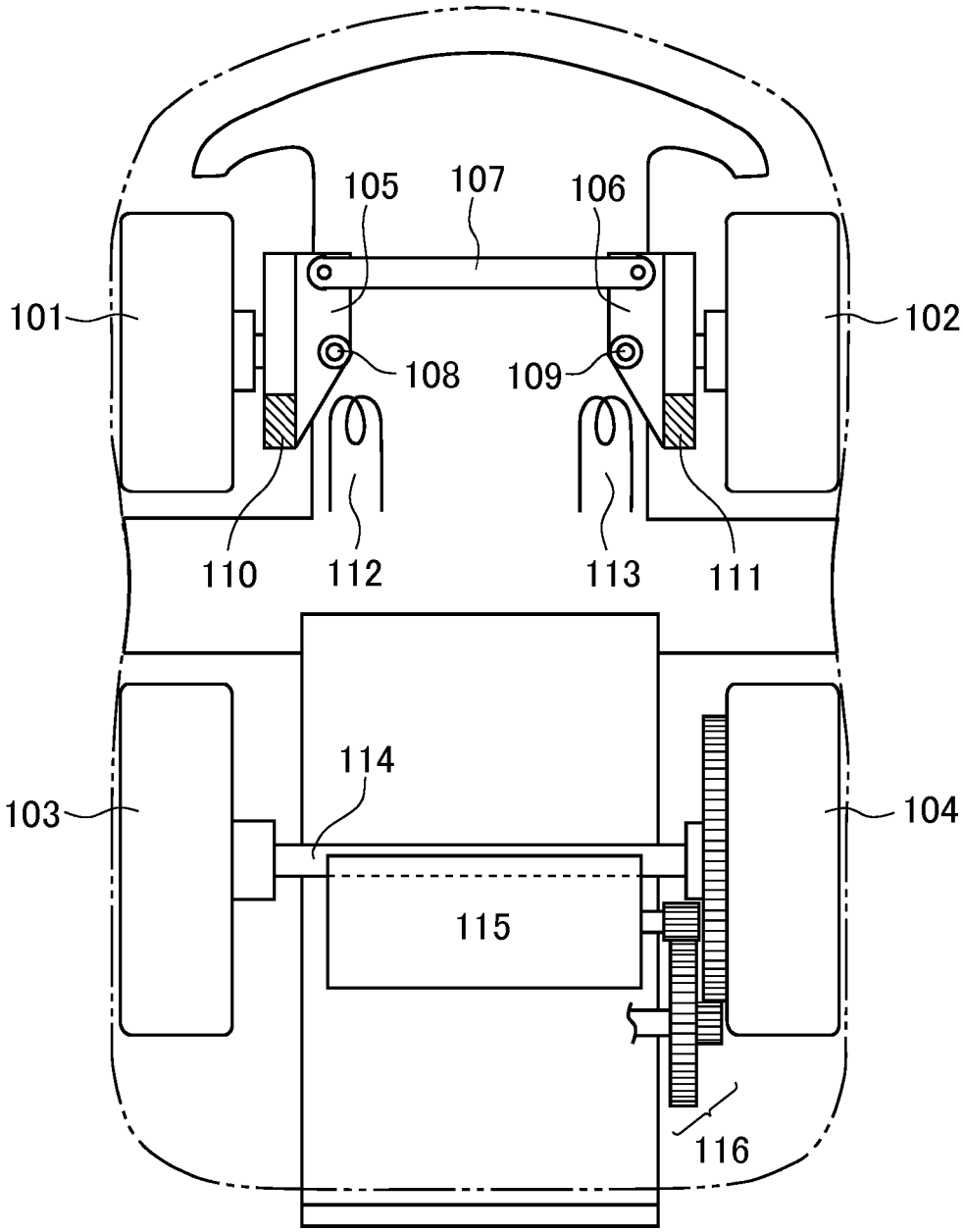
FIG. 3 is a schematic view showing a steering mechanism and a rear-wheel rotating mechanism of the electrically-operated car toy.

FIG. 3 is a schematic view showing a steering mechanism and a rear-wheel rotating mechanism of the electrically-operated car toy.

Figure 4:
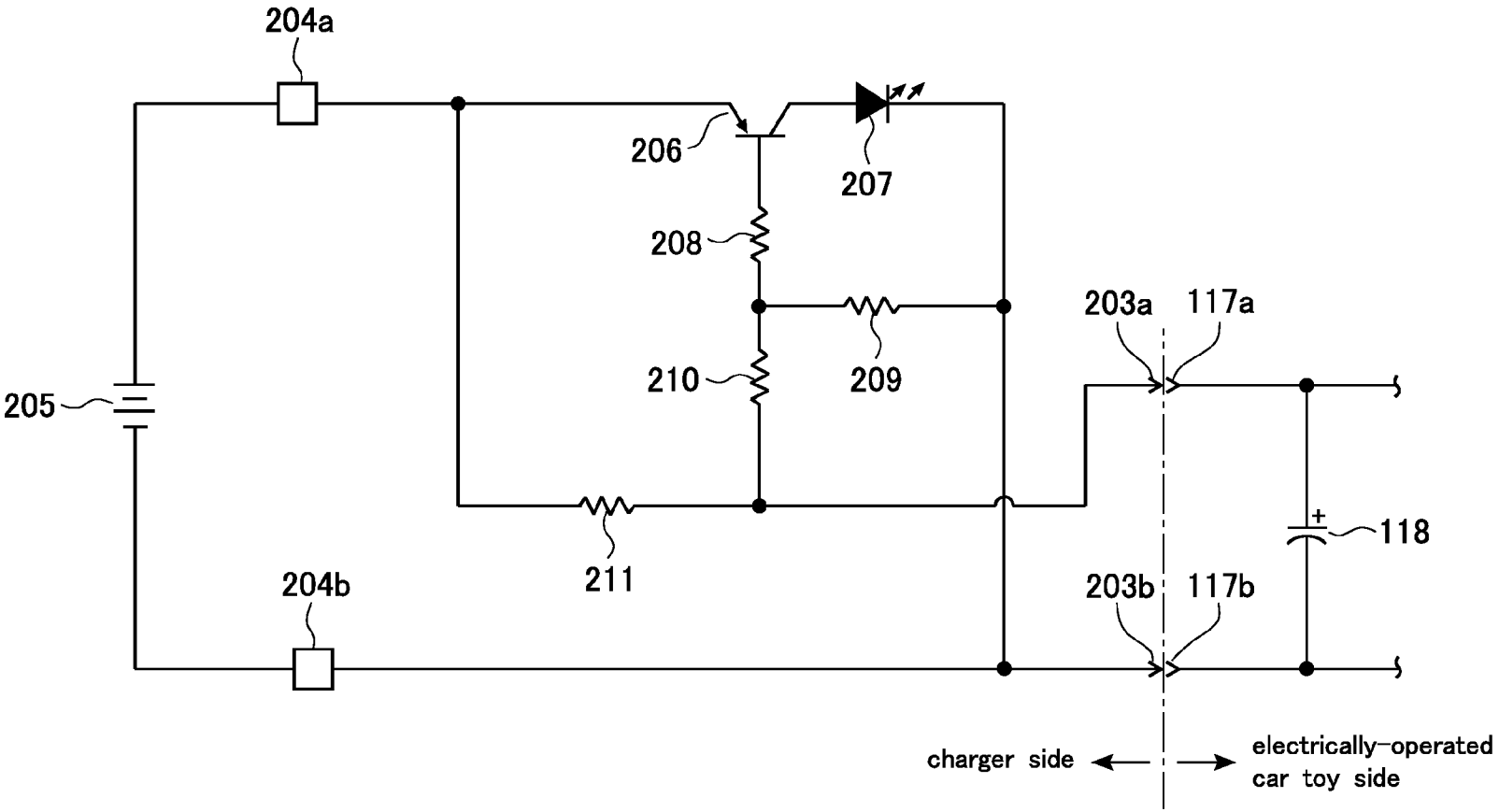
FIG. 4 is a circuit diagram of the battery-type charger.

FIG. 4 is a circuit diagram of the battery-type charger.

Figure 5:
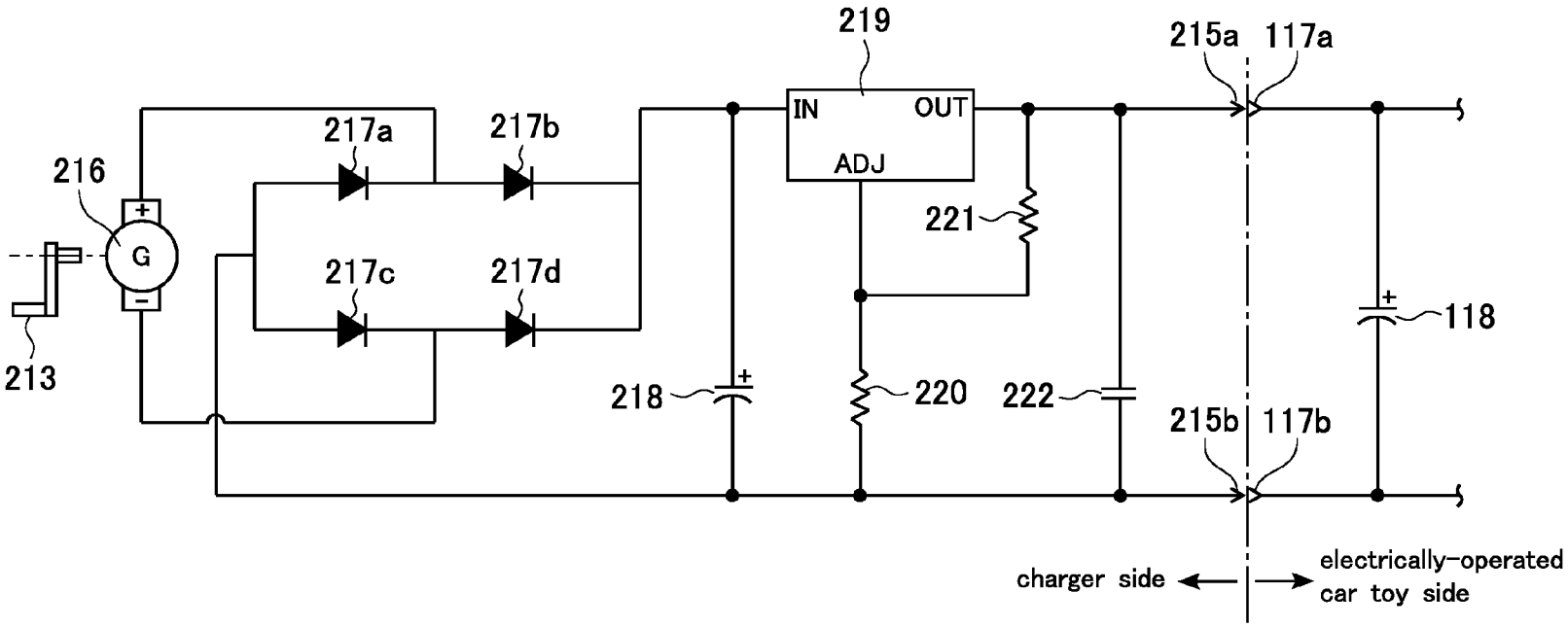
FIG. 5 is a circuit diagram of the hand power generation-type charger.

FIG. 5 is a circuit diagram of the hand power generation-type charger.

Figure 6:
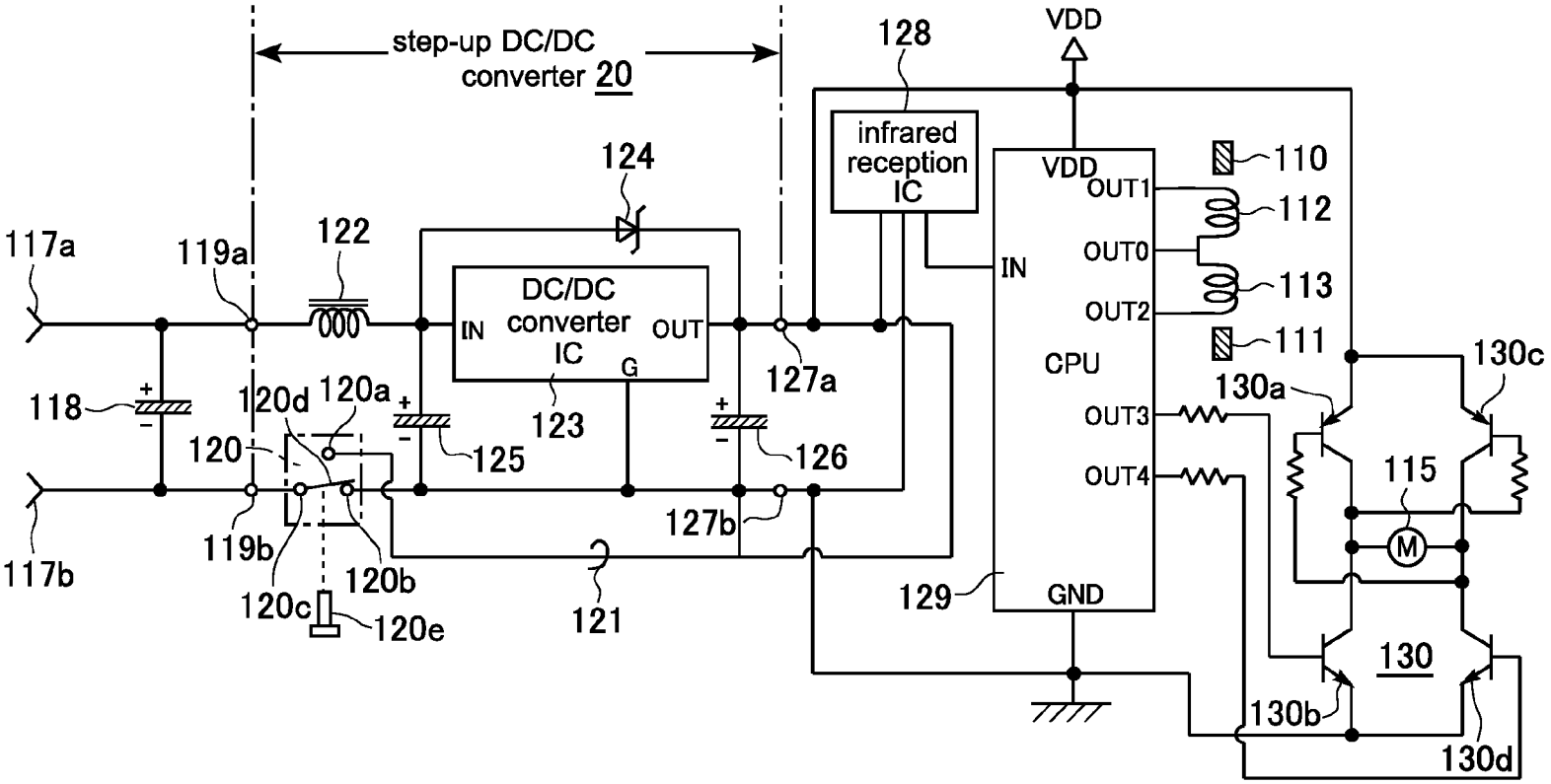
FIG. 6 is a circuit diagram (part 1) of the electrically-operated car toy.

FIG. 6 is a circuit diagram (part 1) of the electrically-operated car toy.

Figure 7:
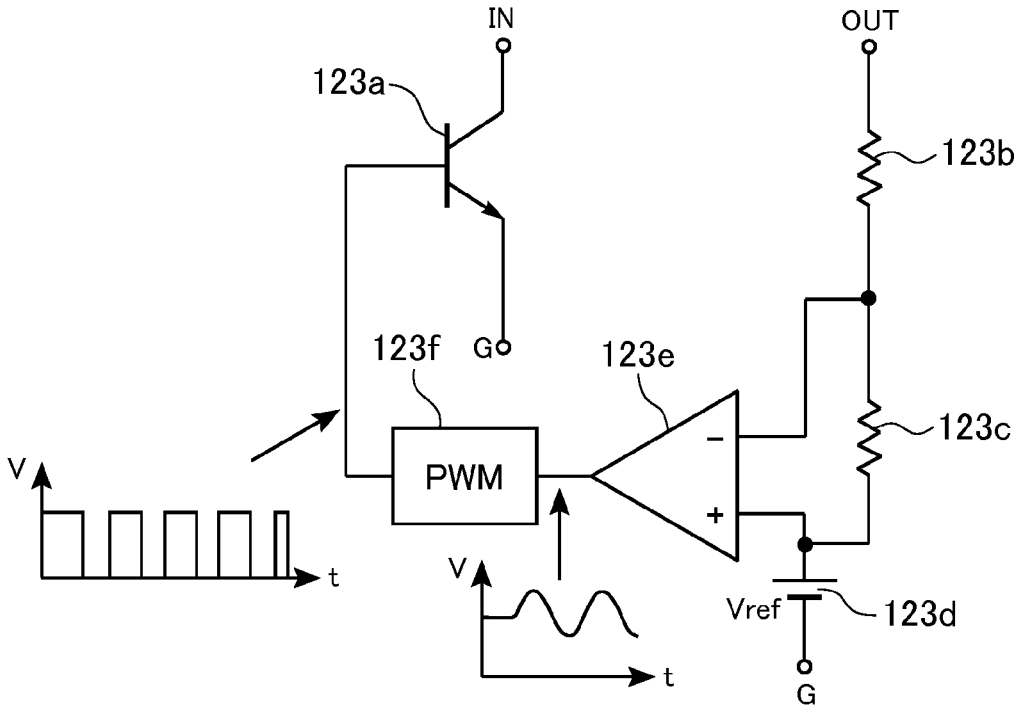
FIG. 7 is a circuit diagram (part 1) of the major part of a DC/DC converter IC.

FIG. 7 is a circuit diagram (part 1) of the major part of a DC/DC converter IC.

Figure 8:
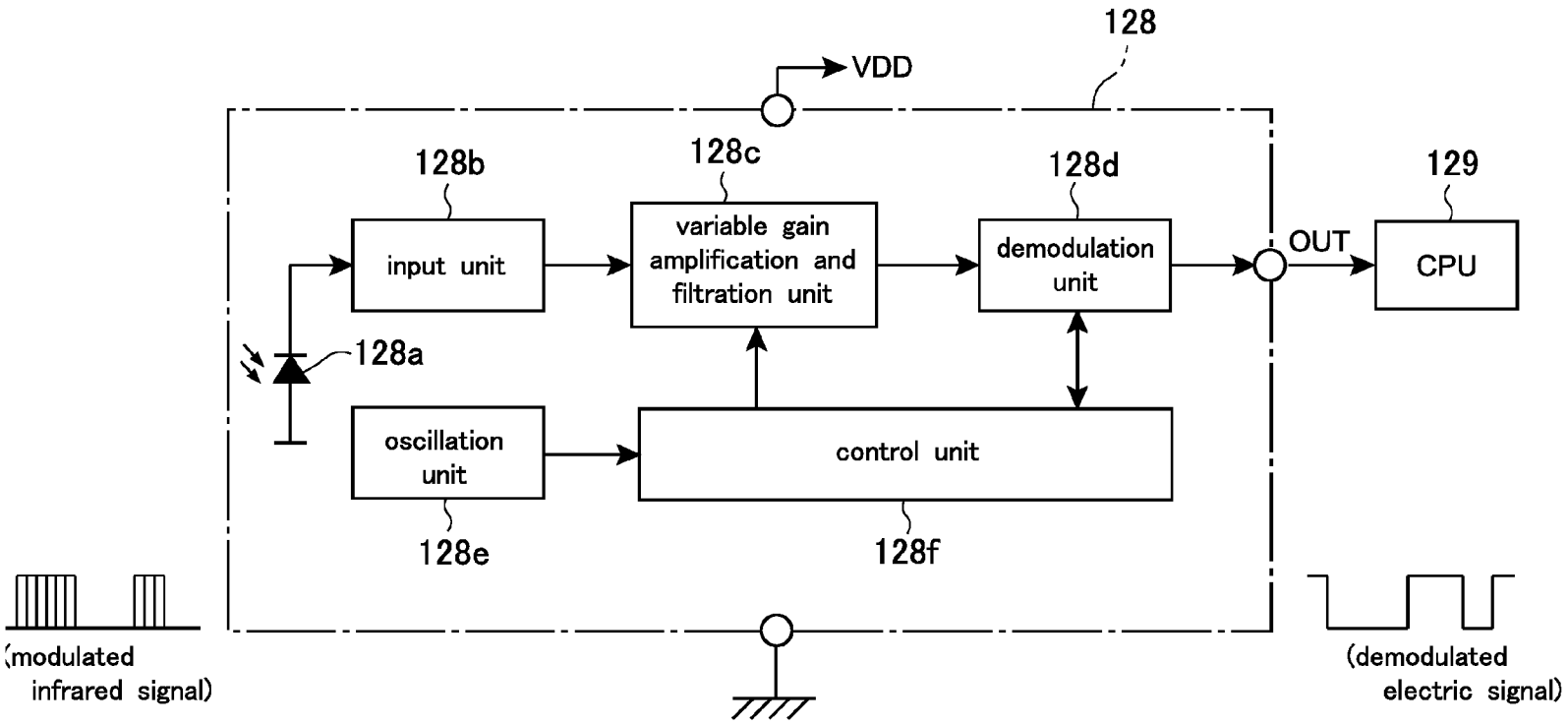
FIG. 8 is an internal circuit diagram of an infrared reception IC.

FIG. 8 is an internal circuit diagram of an infrared reception IC.

Figure 9:
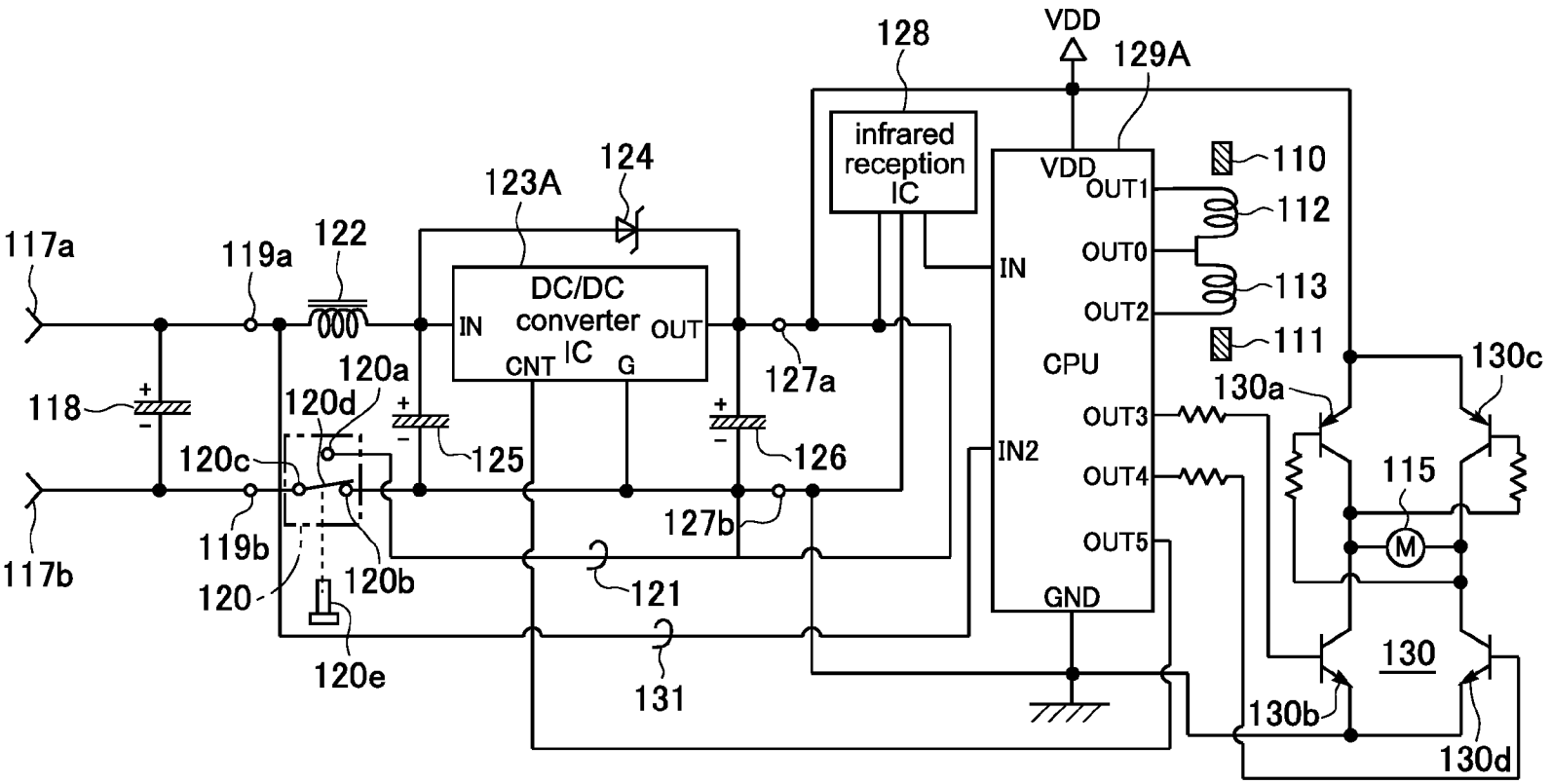
FIG. 9 is a circuit diagram (part 2) of the electrically-operated car toy.

FIG. 9 is a circuit diagram (part 2) of the electrically-operated car toy.

Figure 10:
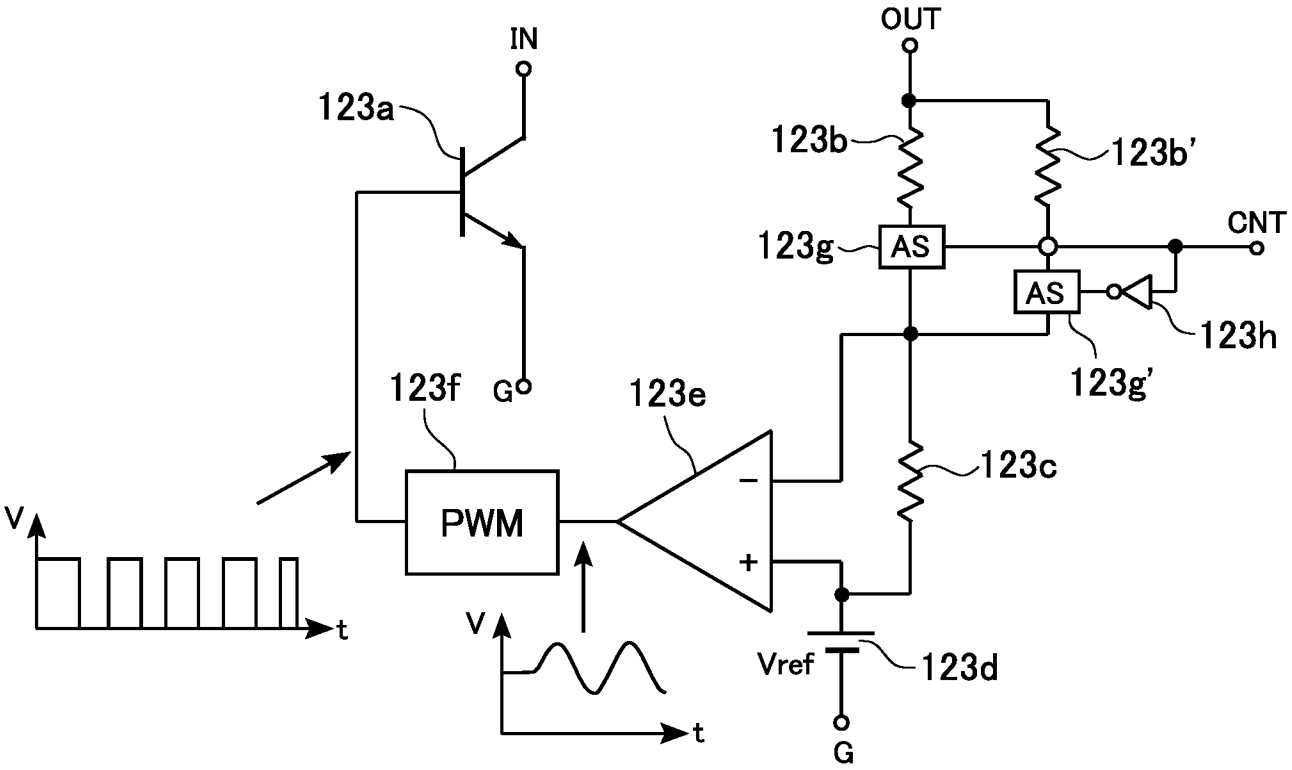
FIG. 10 is a circuit diagram (part 2) of the major part of the DC/DC converter IC.

FIG. 10 is a circuit diagram (part 2) of the major part of the DC/DC converter IC.

Figure 11:
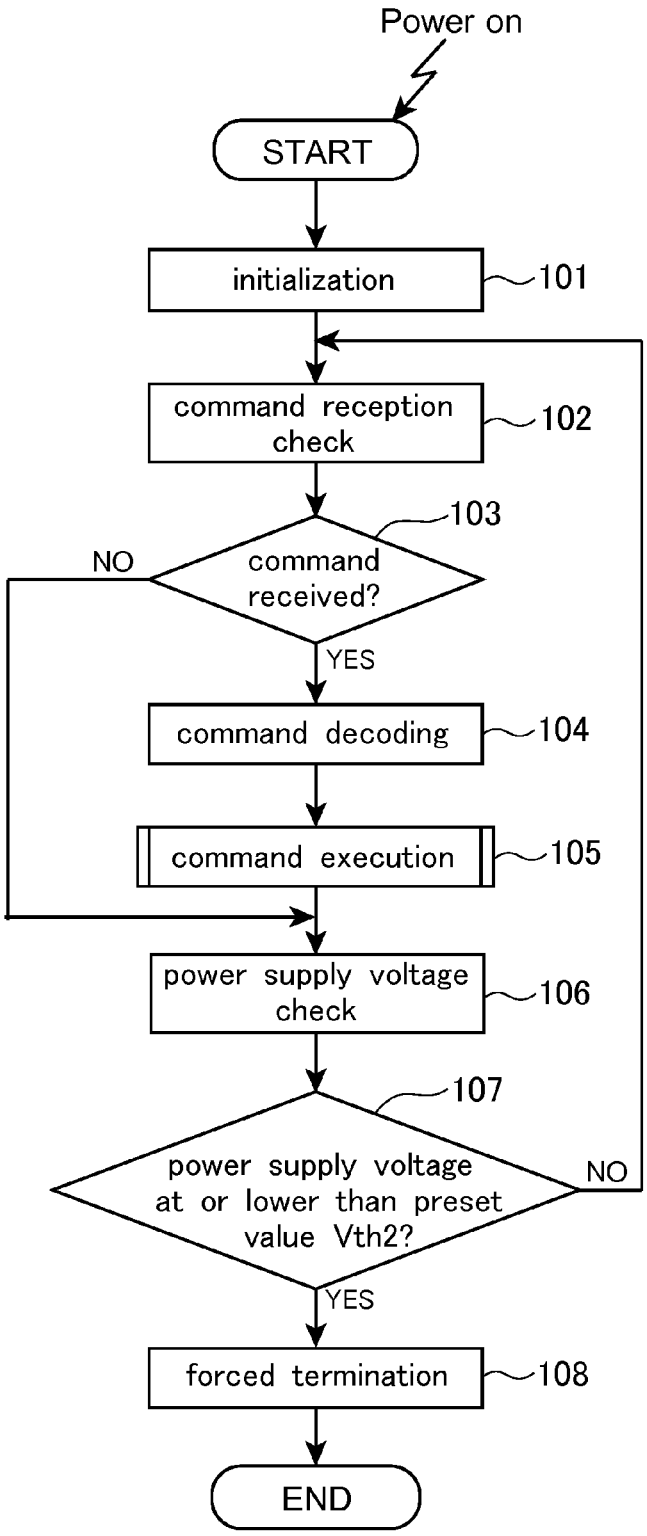
FIG. 11 is a general flowchart showing the outline of a program executed in a CPU in its entirety.

FIG. 11 is a general flowchart showing the outline of a program executed in a CPU in its entirety.

Figure 12:
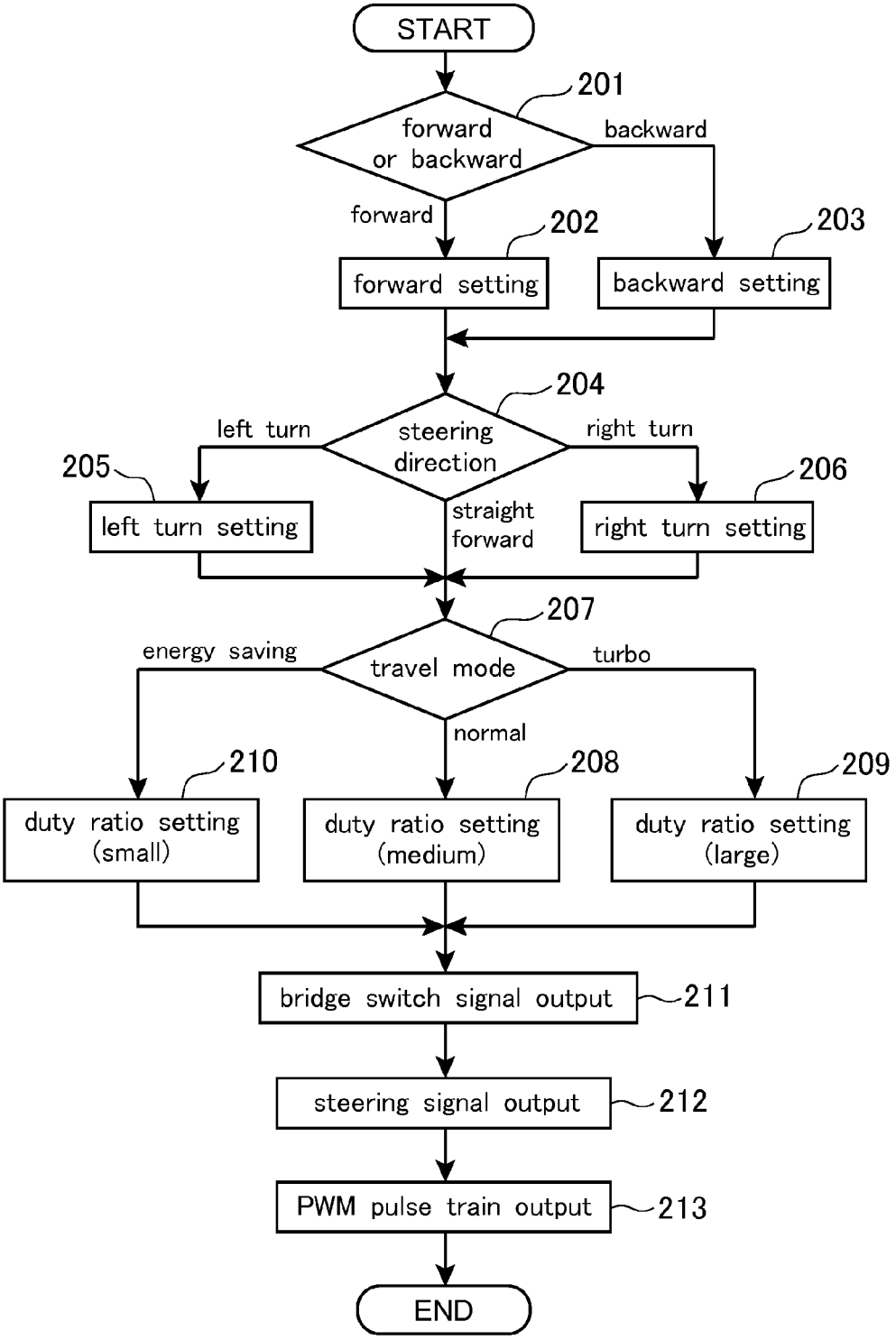
FIG. 12 is a detailed flowchart of a command execution processing.

FIG. 12 is a detailed flowchart of a command execution processing.

Figure 13:
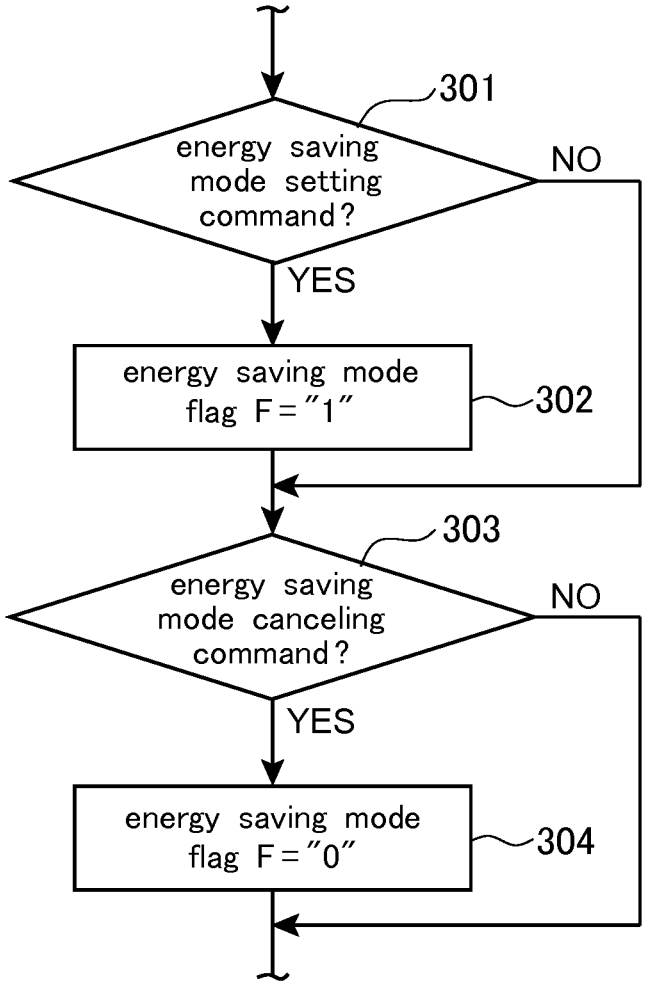
FIG. 13 is a flowchart of an energy saving mode control processing included in a command decoding processing.

FIG. 13 is a flowchart of an energy saving mode control processing included in a command decoding processing.

Figure 14:
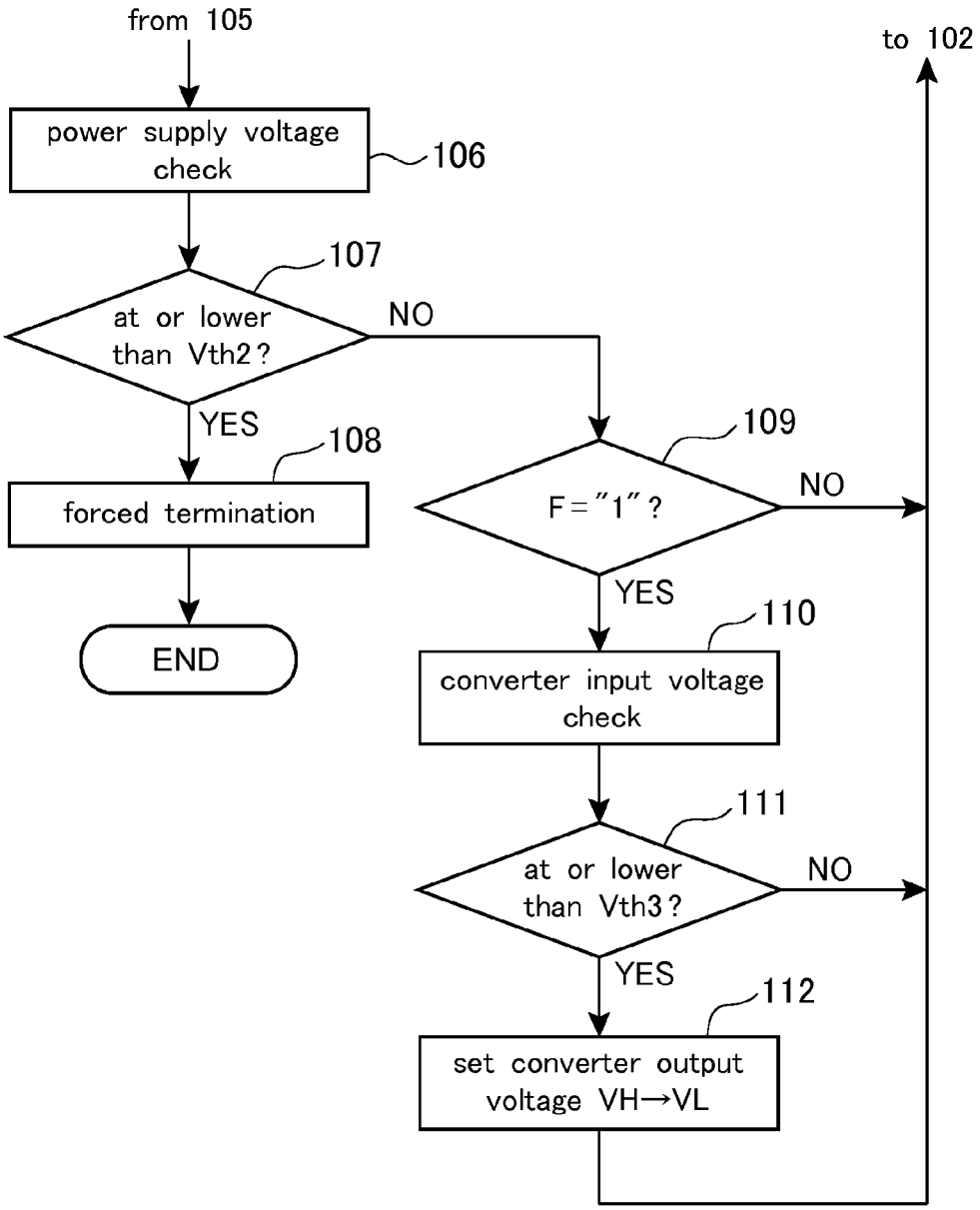
FIG. 14 is a flowchart of a power saving processing in an energy saving mode.

FIG. 14 is a flowchart of a power saving processing in an energy saving mode.

Figure 15:
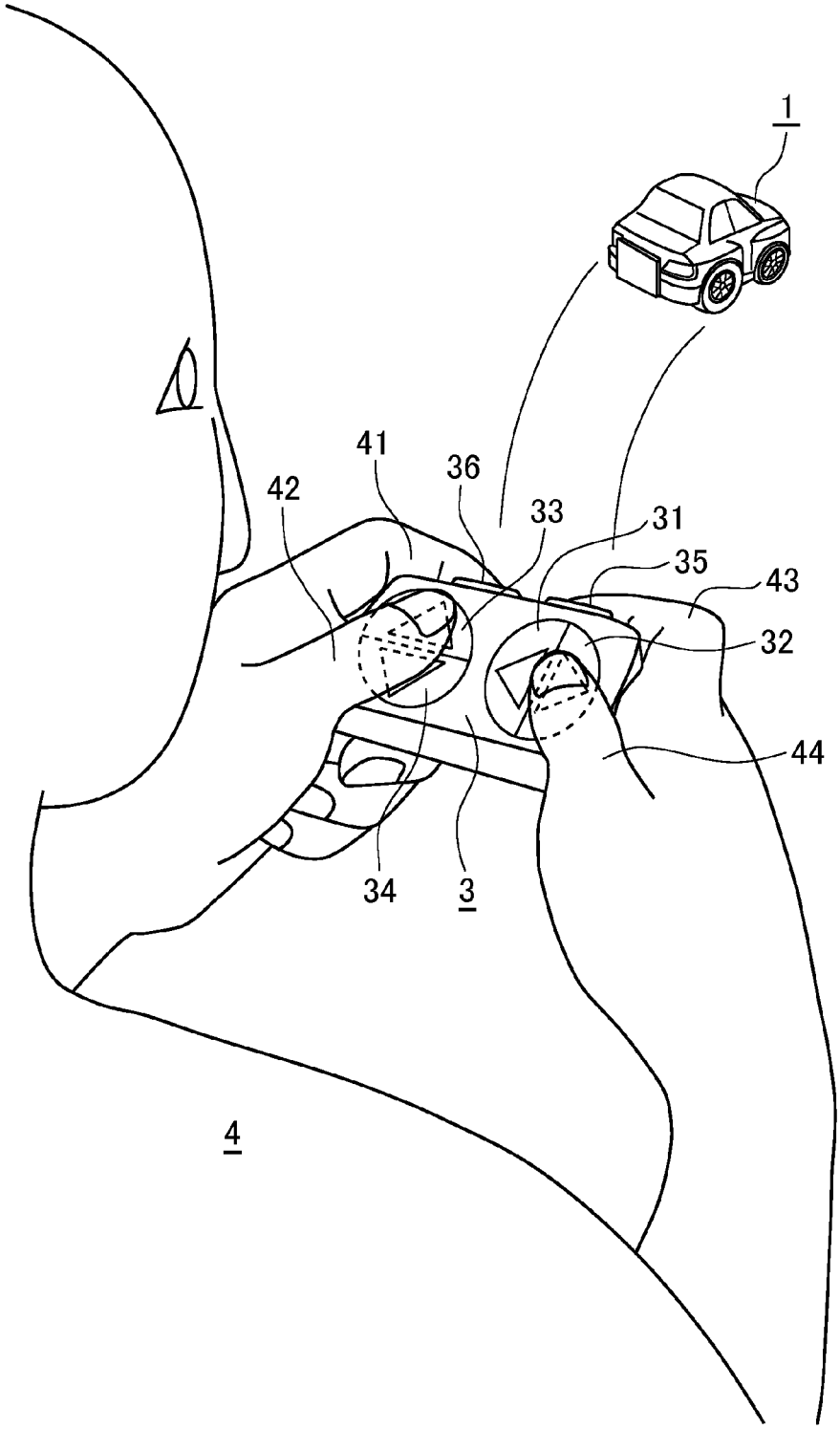
FIG. 15 is a perspective view showing the state of use of the electrically-operated car toy.

FIG. 15 is a perspective view showing the state of use of the electrically-operated car toy.

Figure 16:
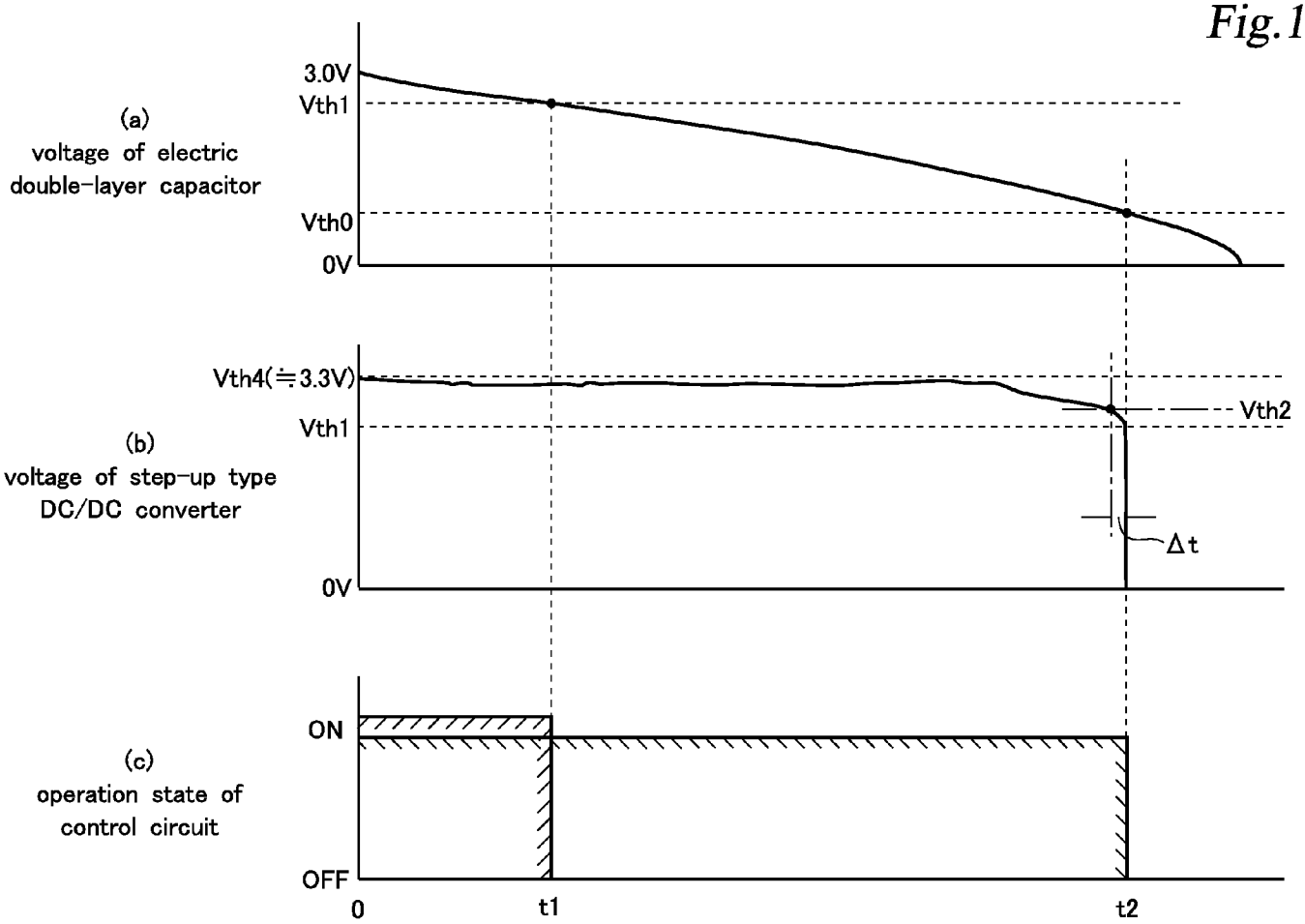
FIG. 16 is a view illustrating the operation (normal mode) of the circuit diagram (part 1) of the electrically-operated car toy.

FIG. 16 is a view illustrating the 等制寸羅 operation (normal mode) of the circuit diagram (part 1) of the electrically-operated car toy.

Figure 17:
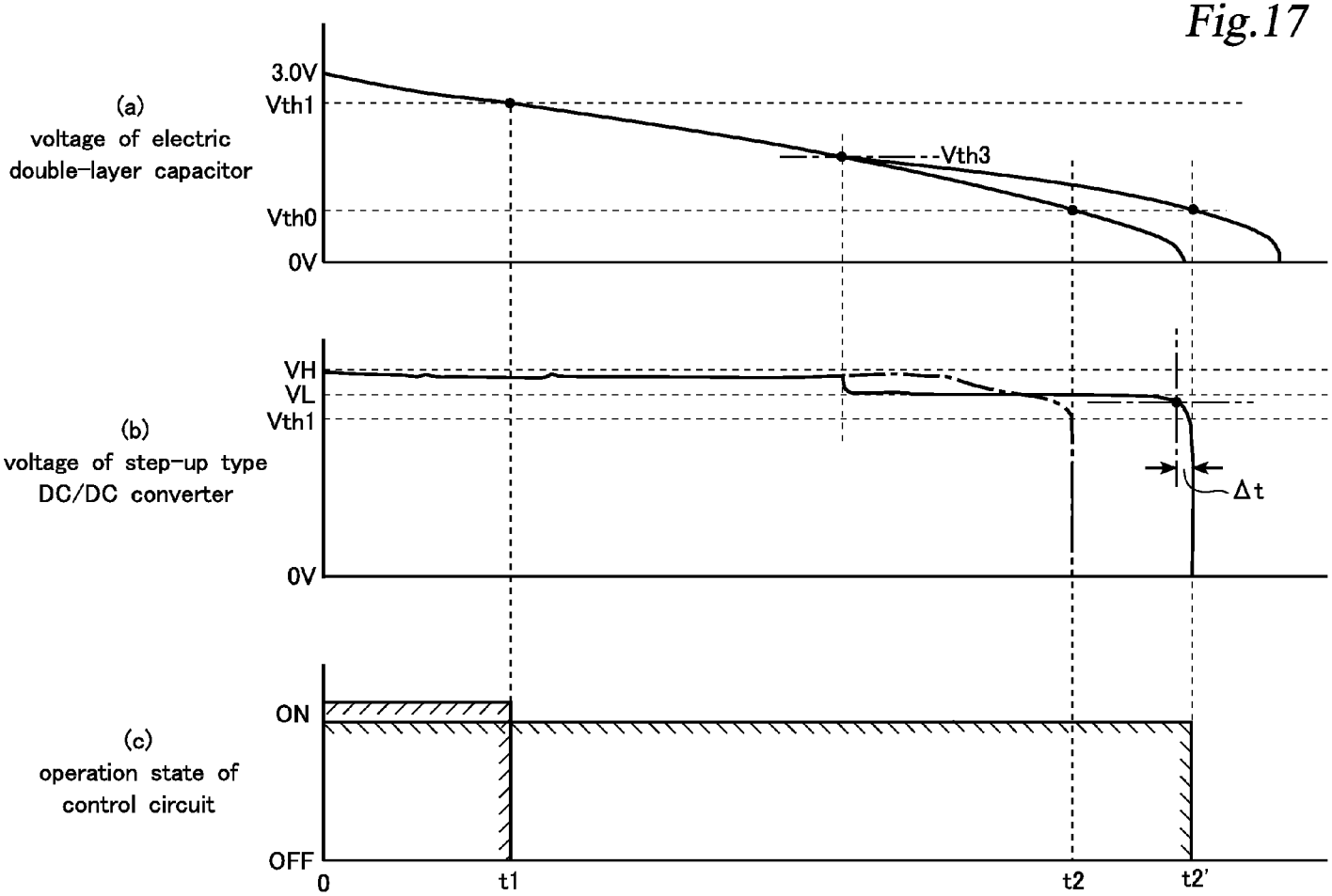
FIG. 17 is a view illustrating the operation (energy saving mode) of the circuit diagram (part 2) of the electrically-operated car toy.

FIG. 17 is a view illustrating the operation (energy saving mode) of the circuit diagram (part 2) of the electrically-operated car toy.

MODE FOR CARRYING OUT THE INVENTION

In the following, one preferred embodiment of an electrically-operated toy according to the present invention will be described in detail with reference to FIGS. 1 to 17.

<Mechanistic Configuration of Electrically-Operated Car Toy>

—Mechanism Required for Charge—

As shown in FIG. 1(*a*), an electrically-operated car toy 1, in this example, has a small plastic car body having an overall length of about several tens of millimeters, and on the bottom of the car body, a power reception terminal receptacle 117 (see reference signs 117*a*, 117*b* in FIG. 4) that is electrically continuous with the terminals of an electric double-layer capacitor embedded in the car body is provided. As will be described later, during charge, this power reception terminal receptacle 117 (see reference signs 117*a*, 117*b* in FIG. 4) is connected with a power supply terminal plug 203 (203*a*, 203*b*) or 215 (215*a*, 215*b*) of a charger 2A or 2B.

—Front-Wheel Steering Mechanism and Steering Drive Source—

As shown in FIG. 3, of left and right front wheels 101, 102, the left front wheel 101 is rotatably supported through an axle on a support member 105 that rotates around an axis 108, and similarly, the right front wheel 102 is rotatably supported through an axle on a support member 106 that rotates around an axis 109. The left and right support members 105 and 106 are coupled with each other through a link rod 107. A steering magnet 110, which is a permanent magnet, is fixed on the left support member 105, and a steering coil (exciting coil) 112 constituting an electromagnet is disposed at a position opposite to the steering magnet 110, and similarly, a steering magnet 111, which is a permanent magnet, is fixed on the right support member 106, and a steering coil (exciting coil) 113 is disposed at a position opposite to the steering magnet 111. Therefore, it is possible to steer the electrically-operated car toy to the left side by energizing the left-side steering coil 112 and thereby suctioning the steering magnet 110, and conversely, it is possible to steer the electrically-operated car toy to the right side by energizing the right-side steering coil 113 and thereby suctioning the steering magnet 111. Thus, the left and right support members 105, 106, the left and right steering magnets 110, 111, and the link rod 107 configure the steering mechanism, while the left and right steering coils 112, 113 configure the steering drive source. When neither of the steering coils is energized, the steering mechanism is returned to a neutral position between the left and right sides by a not shown biasing member such as a spring.

—Rear-Wheel Rotating Mechanism and Rear-Wheel Electric Motor—

As shown in FIG. 3, left and right rear wheels 103, 104 are supported so as to be integrally rotatable through a rear-wheel axle 114. The rotative power obtained from a rotary electric motor 115 is transmitted to the right rear wheel through a gear train 116 that is formed by sequentially meshing a small-diameter gear fixed on the output shaft of the rotary electric motor, a middle-diameter gear rotating integrally with an intermediate shaft, a small-diameter gear rotating integrally with the intermediate shaft, and a large-diameter gear fixed on the rear-wheel axle. Thus, the gear train 116 formed of the four gears configures the rear-wheel rotating mechanism, and the rotary electric motor 115 configures the rear-wheel electric motor.

<Circuit Configuration of Electrically-Operated Car Toy>

—Electric Double-Layer Capacitor—

As shown in FIG. 6, an electric double-layer capacitor 118, which is the major part of the present invention, is provided in the first stage of a circuit configuring the electrically-operated car toy 1. The shown electric double-layer capacitor 118 is constituted of a single capacitor element having a relatively small capacity (e.g., about 1 to 5 F). The positive-side terminal (+) of this electric double-layer capacitor 118 is connected with a positive-side line that is electrically continuous with one power reception terminal receptacle 117*a* of a pair of power reception terminal receptacles, while the negative-side terminal (−) is connected with a negative-side line that is electrically continuous with the other power reception terminal receptacle 117*b* of the pair of power reception terminal receptacles. Therefore, the electric double-layer capacitor 118 can be charged by plug-connecting the power supply terminal plugs (203*a*, 203*b*, or 215*a*, 215*b*) of the above-described charger with the power reception terminal receptacles 117*a*, 117*b*.

The positive-side terminal (+) of the electric double-layer capacitor 118 is also connected with one input terminal 119*a* of a pair of input terminals of a chopper-type step-up DC/DC converter 20, while the negative-side terminal (−) is also connected with the other input terminal 119*b* of the pair of input terminals of the chopper-type step-up DC/DC converter 20.

—Chopper-Type Step-Up DC/DC Converter (Part 1)—

In this example, the step-up type DC/DC converter 20 includes a series coil 122 that is a core coil, a DC/DC converter IC 123, a Schottky diode 124, an input-side parallel capacitor 125 that is an electrolytic capacitor, and an output-side parallel capacitor 126 that is an electrolytic capacitor.

As shown in FIG. 7, the DC/DC converter IC 123 is internally composed of a deviation amplification circuit 123*e* that obtains a deviation between the output voltage of the converter 20 detected through two partial resistors 123*b*, 123*c* and a reference voltage 123*d* corresponding to a target output voltage, a PWM circuit 123*f* that outputs a pulse train of a duty ratio required for zeroing the deviation on the basis of the output of the deviation amplification circuit 123*e*, and a transistor chopper 123*a* that performs switching operation in synchronization with the pulse train obtained from the PWM circuit 123*f*.

In the DC/DC converter 20, the transistor chopper 123*a* is switched at a high speed in synchronization with the pulse train obtained from the PWM circuit 123 to thereby appropriately boost the input voltage (charging voltage of the electric double-layer capacitor 118) obtained at the input terminals 119*a*, 119*b* to a constant voltage through the actions of the series coil 122, the input-side parallel capacitor 125, the output-side parallel capacitor 126, and the Schottky diode 124. Thereafter, this voltage is supplied from output terminals 127*a*, 127*b*, not only to an infrared reception IC 128 and a CPU (configured of a microprocessor) 129 configuring a control circuit, but also to a transistor bridge circuit (configured of four transistors 130*a*, 130*b*, 130*c*, 130*d*) 130 that acts to switch the direction of application of voltage to the rear-wheel electric motor 115. During boosting operation, the chopper-type step-up DC/DC converter 20 uses the on-off operation of the transistor chopper 123*a* and the inductive action of the coil 122 in order to suck out electric charge from the electric double-layer capacitor 118 constituting the power source. This results in a high power source utilization rate, and the electric charge accumulated in the electric double-layer capacitor 118 can be thoroughly used.

—Power Supply Switch—

As shown in FIG. 6, a power supply switch 120 for turning on and off the power supply to a load circuit (the infrared reception IC 128, the CPU 129, the transistor bridge circuit 130, etc.) is provided in a power supply path leading from the electric double-layer capacitor 118 to the load circuit. The shown power supply switch 120 includes a so-called single-pole double-throw (SPDT) contact that can connect a movable piece 120*d*, which is electrically continuous with a common terminal 120*c*, alternatively with a first terminal 120*a* or a second terminal 120*b*, and can be turned on and off through a manipulation element 120*e* constituted of an appropriate movable mechanism. The state where the movable piece 120*d* is connected with the second terminal 120*b* corresponds to the on state of the power supply switch 120, and in this state, the electric double-layer capacitor 118 acting as a power source, the DC/DC converter 20, and the load circuit (including the rotary electric motor 115, the CPU 129, and the infrared reception IC 128) are serially connected, so that power is supplied from the DC/DC converter 20 to the load circuit. Conversely, the state where the movable piece 120*d* is connected with the first terminal 120*a* corresponds to the off state of the power supply switch 120. In the off state, as the movable piece 120*d* is connected with the first terminal 120*a*, short-circuit occurs between the positive-side line and negative-side line on the output side of the DC/DC converter 20 through a short-circuit line 121. As a result, even when there is electric charge remaining in the capacitance components of the outlet-side parallel capacitor 126 etc. at the point in time when the power supply switch 120 is turned off, the electric charge remaining in the capacitance components is instantly discharged through the short-circuit line 121, so that the power source voltage applied to the CPU 129 can be instantly zero-reset. Therefore, if the power supply switch 120 is turned from off to on after that, the power source voltage applied to the CPU 129 reliably rises from zero volts instantly, and any given program can be reliably started by normally actuating the power-on reset function incorporated in the CPU 129.

—Infrared Reception IC—

As shown in FIG. 8, the infrared reception IC 128 is internally composed of a photodiode 128*a* that receives a modulated infrared (command) signal and converts it into an electric signal, an input unit 128*b* that amplifies the electric signal obtained from the photodiode 128*a* to an appropriate level, a variable gain amplification and filtration unit 128*c* that amplifies the electric signal obtained from the input unit 128*b* to a constant level and extracts the signal of an intended frequency from the amplified signal, an oscillation unit 128*e* that generates a reference clock signal, and a control unit 128*f* that controls the operation of the variable gain amplification and filtration unit 128*e* and a demodulation unit 128*d* in synchronization with the clock signal obtained from the oscillation unit 128*e*. The demodulated electric (command) signal obtained from the demodulation unit 128*d* is supplied to the CPU 129 to be described later.

In this example, as shown in FIG. 15, the modulated infrared (command) signal received by the infrared reception IC is sent from an infrared remote controller (hereinafter called an infrared remote) 3. The infrared remote 3 is provided with a left turn button 31, a right turn button 32, a forward button 33, a backward button 34, as well as a turbo button 35 and an energy saving button 36. The infrared remote 3 is configured such that a player 4 selectively manipulates the left turn button 31 and the right turn button 32 with a right thumb 44 while selectively manipulating the forward button 33 and the backward button 34 with a left thumb 42, and further manipulates the turbo button 35 with a right index finger 43 and the energy saving button with a left index finger 41.

When one of these buttons 31 to 36 is manipulated, a control command corresponding to the manipulated button is generated and sent to the electrically-operated car toy 1 as a corresponding modulated infrared (command) signal.

—CPU Configured of a Microprocessor—

The CPU 129 serving as a central processing unit is configured of a microprocessor, and in the example shown in FIG. 6, has one input port IN and five output ports OUT0 to OUT4. The input port IN takes in the modulated electric (command) signal output from the infrared reception IC 128. The output ports OUT0 to OUT2 selectively drive the left and right steering coils 112, 113. The output ports OUT3 and OUT4 appropriately set the four transistors 130*a* to 130*d* configuring the transistor bridge circuit 130 to on or off to thereby switch the direction of the current flowing through the rear-wheel electric motor 115.

The microprocessor serving as the CPU 129 has further a built-in function, so-called power-on reset function, of normally starting a program on the basis of the power source voltage detected through a power source terminal VDD rising from zero. To allow this function to work normally, the voltage of the power source line immediately before a rise of the power source voltage should be near zero volts. As described already, this is guaranteed because, in the off state of the power supply switch 120, the power source line inside the control circuit is short-circuited through the short-circuit line 121 and the electric charge accumulated in the capacitance components is completely discharged.

<Program Executed by Microprocessor Configuring CPU>

—Program Related to Steering of Electrically-Operated Car Toy—

As shown in FIG. 11, when the power-on reset function works upon power on and execution of the program is started, first, an initialization process (step 101) is executed to reset various flags and registers required for calculation, and then a command reception check process (step 102) is executed to check whether or not any command is received on the basis of a modulated electric (command) signal taken in through the input port IN (see FIG. 6). Here, if it is determined that a command is received (YES in step 103), the command is decoded (step 104) and then a command execution process (step 105) according to the decoding result is executed.

FIG. 12 shows details of the command execution process in the case of a steering-related command. When the process is started, it is determined whether the command is a forward command or a backward command (step 201), and if the command is a forward command (FORWARD in step 201) a process of storing a forward setting (step 202) is executed, and if the command is a backward command (BACKWARD in step 201) a process of storing a backward setting (step 203) is executed.

Next, it is determined whether a steering direction command indicates right turn, straight forward, or left turn (step 204), and according to the determination result, a process of storing a left turn setting (step 205) is executed in the case of left turn, and a process of storing a right turn setting (step 206) is executed in the case of right turn. In the case of straight forward, straight forward operation can be performed through the action of a return spring of the steering mechanism without requiring any manipulation.

Next, it is determined whether a travel mode command indicates normal mode, turbo mode, or energy saving mode (step 207), and in the case of the normal mode a process of storing a duty ratio setting (medium) (step 208) is executed, in the case of the turbo mode a process of storing a duty ratio setting (large) (step 209) is executed, and in the case of the energy saving mode a process of storing a duty ratio setting (small) (step 210) is executed.

Next, depending on which of the forward setting and the backward settings is stored, a corresponding bridge switch signal is output from the output port OUT3 or OUT4, and the four transistors 130*a* to 130*d* configuring the transistor bridge circuit 130 are appropriately turned on or off, so that the rear-wheel electric motor 115 is energized in the direction corresponding to forward or backward.

Next, depending on which of the large, medium, and small duty ratio settings is stored, a PWM pulse train of an appropriate duty ratio is generated and fed to the base of the pair of transistors (130*a* and 130*d* or 130*c* and 130*d*) configuring the transistor bridge circuit 130.

In this way, the car toy 1 travels as commanded through the infrared remote 3. In particular, in this example, since the energy saving mode is designated through the infrared remote, the car toy 1 travels at low speed, so that consumption of the electric double-layer capacitor is avoided and travel for a longer time can be realized.

—Program Against Rapid Decrease in DC/DC Converter Output—

According to the present invention, extension of the retention time of power source voltage supplied to the load circuit is achieved through the provision of the step-up DC/DC converter 20 on the output side of the electric double-layer capacitor 118. Nevertheless, a rapid decrease is recognized (see FIGS. 16, 17) in the power source voltage thus obtained, when the charging voltage of the electric double-layer capacitor 118 falls below the minimum operation voltage (Vth0) of the DC/DC converter 20. Therefore, in this example, as shown in FIG. 11, the power source voltage is constantly monitored (step 106), and when the power source voltage decreases to or below a specified power source voltage value (Vth2) at which a rapid voltage decrease is expected to occur soon (after Δt) (YES in step 107), the program being executed is forcibly terminated to thereby prevent the microprocessor from reaching an unstable state (step 108). The adoption of such configuration makes it possible to prevent malfunction attributable to unstable operation of the microprocessor 129 resulting from a sudden rapid decrease in the power source voltage (VDD).

—Program for Energy Saving through Change of Set Value of DC/DC Converter—

The present invention boosts and stabilizes the output voltage of the electric double-layer capacitor 118 by placing the step-up DC/DC converter 20 on the output side of the electric double-layer capacitor 118. However, it is not absolutely necessary that the value of the stabilized voltage that is given to the control circuit being a load is constant throughout the operation. Accordingly, if the value of the stabilized voltage can be changed anytime on the user side, a more user-friendly power supply circuit can be configured, and the electric charge charged in the electric double-layer capacitor 118 can be retained for a longer time by using this power supply circuit. Therefore, in this example, the energy saving mode is set through the infrared remote at any given point in time, and thereby the output voltage of the DC/DC converter 20 can be changed at that point in time.

That is, in this example, as shown in FIG. 9 and FIG. 10, a DC/DC converter IC 123A is used that has a control terminal CNT for selecting from the outside either one of two types of resistors 123*b*, 123*b*' of different values as a partial resistor for detecting the output voltage. In FIG. 10, either one of two analog switches 123*g*, 123*h* is turned on when the logical value of the control terminal CNT is designated, and either one of the resistor 123*b* and the resistor 123*b*' can be selected. Through this selection, as shown in FIG. 17, the target output voltage value can be set to either VH or VL.

As shown in FIG. 9, on the CPU 129A side, the charging voltage of the electric double-layer capacitor 118 is detected from the input port IN2 through a detection line 131, and the control terminal CNT of the DC/DC converter IC 123A can be manipulated from the output port OUT5.

A process is further incorporated as a program to be incorporated into the CPU 129A, which, during the command decoding process (step 104) in the program shown in FIG. 14, if the energy saving mode setting command is decoded (YES in step 301) as shown in FIG. 13, sets an energy saving mode flag F (step 302), and if the energy saving mode canceling command is decoded (YES in step 303), resets the energy saving mode flag F (step 304).

In addition, as shown in FIG. 14, a program is incorporated (see FIG. 17) that checks the input voltage of the DC/DC converter 20 when the energy saving mode flag F is set (YES in step 109), and reduces the value of the set output voltage of the DC/DC converter 20 from VH to VL when the value of the input voltage is at or lower than a preset specific voltage (Vth3). According to such configuration, if the input voltage of the DC/DC converter 20, that is, the amount of electric charge remaining in the electric double-layer capacitor 118 decreases to some degree, the travel duration time can be extended by changing the value of the target retention voltage of the DC/DC converter (e.g., from VH to VL). Various other forms of utilization of this operation of changing the target retention voltage are possible. For example, it is possible to uniformize the DC/DC converter output over the entire discharge period by setting the target retention voltage initially to a lower value and then setting it to a higher value after a lapse of a certain time to thereby compensate the trend of the DC/DC converter output voltage decreasing shortly before the end of discharge of the capacitor.

—Effect of Maintaining Power Source Voltage of this Embodiment—

In this embodiment, as shown in the graph of FIG. 16, the step-up DC/DC converter 20 has a minimum operable voltage (operation guarantee voltage) Vth0 (about 0.7V) that is lower than the power source voltage (operation guarantee voltage) Vth1 (e.g., about 2.5V) required for actuation of the control circuit (e.g., the infrared reception IC 128 and the CPUs 129, 129A), and a constant output voltage (output retention voltage) Vth4 (e.g., 3.3V) that is higher than the power source voltage Vth1 (e.g., 2.5V) required for actuation of the control circuit.

Therefore, according to this embodiment, even when the charging voltage of the electric double-layer capacitor 118 decreases below the power source voltage Vth1 required for actuation of the control circuit, until the value falls to the minimum operable voltage Vth0, the value of the output voltage of the DC/DC converter 20 can be substantially maintained at a constant voltage that is higher than the power source voltage Vth1 required for actuation of the control circuit. Thus, it is possible to use the electric double-layer capacitor 118 as a main power source and yet to secure an operation duration time per charge t2 that is long enough to fully satisfy the users who are infants, younger school children, etc. It is needless to say that, without the DC/DC converter, the operation duration time is as significantly shorter as t1. According to experiments of the present inventors, a lord circuit of 50 mA (relatively large load circuit expected) was connected to the output side of a DC/DC converter (synchronization-type step-up DC/DC converter IC (PFM control) manufactured by Silicon Power Electronics, model number SP9262), and in this state, four types of electric double-layer capacitors with varying electrostatic capacities (1.0 F, 1.5 F, 2.0 F, 3.3 F) were charged to 3V. The resulting operation duration times (t1, t2) of the load circuit are roughly as follows.

| Electrostatic capacity | t1 | t2 |
|---|---|---|
| 1.0 F | 3 sec. | 24 sec. |
| 1.5 F | 4 sec. | 31 sec. |
| 2.0 F | 8 sec. | 46 sec. |
| 3.3 F | 12 sec. | 62 sec. |

According to this embodiment, as shown in FIG. 17, the energy saving mode is set at any given point in time, and after waiting for the output voltage of the DC/DC converter to fall to the preset voltage Vth3, the value of the target output voltage of the DC/DC converter is automatically changed from VH to VL. Thus, the power source voltage retention time can be extended from the time t2 to the time t2'.

<Mechanistic Configuration of Charger>

—Battery-Type Charger—

As shown in FIG. 1(*a*), the battery-type charger 2A has a relatively thin horizontally-long rectangular casing 201. In this casing 201, a circuit board, on which two AA-size alkaline batteries and a charging circuit (see FIG. 4) configuring the charging power source are mounted, is housed. On the upper surface of the casing 201, a support base part 202, on which the car toy 1 is placed, and the power supply terminal plug 203 (see reference signs 203*a*, 203*b* in FIG. 4) to be connected with the power reception terminal receptacle 117 (see reference signs 117*a*, 117*b* in FIG. 4) provided on the bottom of the car toy 1 placed on the support base part 202 are provided. An LED indicator lamp 207 for indicating that the car toy is being charged is provided on a side surface of the casing 201.

As shown in FIG. 1(*b*), when the car toy 1 is placed on the support base part 202 of the battery-type charger 2A, the power reception terminal receptacle 117 (see reference signs 117*a*, 117*b* in FIG. 4) provided on the bottom surface of the car body of the car toy 1 are connected with the power supply terminal plug 203 (see reference signs 203*a*, 203*b* in FIG. 4) provided on the upper surface of the battery-type charger 2A, so that the car toy 1 is firmly fixed on the casing 201, and at the same time, a charge path is formed leading from the charging power source embedded in the battery-type charger 2A to the electric double-layer capacitor 118 embedded in the car toy 1.

As shown in FIG. 1(*b*), with the car toy 1 placed on the support base part 202 of the battery-type charger 2A, there is a clearance ΔL formed between the front wheels 101, 102 and the rear wheels 103, 104 of the car toy and the upper surface of the battery-type charger 2A, so that, even during charge, the steering movement of the front wheels 101, 102 and the rotary movement of the rear wheels 103, 104 are allowed. Thus, even if charge is accidentally started while the power supply switch 120 (see FIG. 6) is on, it is unlikely that the car toy 1 falls out of the battery-type charger 2A.

—Hand Power Generation-Type Charger—

As shown in FIG. 2(*a*), the hand power generation-type charger 2B has a casing 212 of a somewhat longitudinal shape that can be held by the left hand. A hand-turned handle 213 to be manipulated by the right hand for operating an AC power generator 216 (see FIG. 5) housed inside the casing 212 is provided on the right side surface of the casing 212. On the upper surface of the casing 212, a support base part 214, on which the car toy 1 is placed, and a power supply terminal plug 215 (see reference signs 215*a*, 215*b* in FIG. 5) to be connected with the power reception terminal receptacle 117 (see reference signs 117*a*, 117*b* in FIG. 4) on the bottom of the car toy 1 placed on the support base part 214 are provided.

As shown in FIG. 2(*b*), when the car toy 1 is placed on the support base part 214 of the hand power generation-type charger 2B, the power reception terminal receptacle 117 (see reference signs 117*a*, 117*b* in FIG. 4) provided on the bottom surface of the car body of the car toy 1 and the power supply terminal plug 215 (see reference signs 215*a*, 215*b* in FIG. 5) provided on the upper surface of the hand power generation-type charger 2B are connected with each other, and the car toy 1 is firmly fixed on the casing 212, and at the same time, a charge path is formed leading from the charging power source embedded in the hand power generation-type charger 2B to the electric double-layer capacitor 118 embedded in the car toy 1. In this state, turning the hand-turned handle 213 by the right hand while holding the casing 212 by the left hand, combined with the action of a constant voltage circuit to be described later, can charge the electric double-layer capacitor 118 embedded in the car toy. As shown in FIG. 2(*b*), with the car toy 1 placed on the support base part 214 of the hand power generation-type charger 2B, there is a clearance ΔL formed between the front wheels 101, 102 and the rear wheels 103, 104 of the car toy and the upper surface of the battery-type charger 2B. Thus, even during charge, the steering movement of the front wheels 101, 102 and the rotary movement of the rear wheels 103, 104 are allowed, so that, even if charge is accidentally started while the power supply switch 120 (see FIG. 6) is on, it is unlikely that the car toy 1 falls out of the battery-type charger 2B.

<Circuit Configuration of Charger>

—Battery-Type Charger—

As shown in FIG. 4, the circuit of the battery-type charger has a 3V DC power source 205 formed by serially connecting two AA-size alkaline dry batteries. When the power supply terminal plugs 203*a*, 203*b* and the power reception terminal receptacles 117*a*, 117*b* are connected with each other, charge of the electric double-layer capacitor 118 is started through a resistor (1Ω) 211. If the electric double-layer capacitor 118 is initially empty, the voltage across the terminals is almost zero, and a base current flows to a transistor (type 2SA950) 206 through a resistor (200Ω) 210 and a resistor (200Ω) 208, so that the transistor 206 is turned on and the LED indicator lamp (vf=1.9V) 207, which indicates that the toy is being charged, lights. As the charge proceeds and the voltage across the terminals of the capacitor 118 rises to near 3.0V and the voltage between the base and the emitter of the transistor 206 falls below the PN junction forward voltage, the transistor 206 is turned off and the LED lamp 207 goes out. When the plugs 203*a*, 203*b* and the receptacles 117*a*, 117*b* are in poor contact with each other, the LED indicator lamp 207 does not light due to the action of the resistor (1.2Ω) 209. Therefore, the user can easily know if charge has been completed by simply watching the lighting state of the LED lamp 207.

—Hand Power Generation-Type Charger—

As shown in FIG. 5, the circuit of the hand power generation-type charger includes: the AC power generator 216 that generates power through turning of the hand-turned handle 213; diode bridge-type full-wave rectification circuits 217*a* to 217*d* that smoothe the output AC voltage of this AC power generator 216; an electrolytic capacitor 218 that smoothes the output voltage of the full-wave rectification circuits; and a stabilization circuit (the voltage stabilization IC 219 and the partial resistors 220, 221 for output voltage detection, etc.) that stabilizes the DC voltage smoothed by the electrolytic capacitor 218. When the hand-turned handle 213 is turned after the power supply terminal plugs 215*a*, 215*b* and the power reception terminal receptacles 117*a*, 117*b* are connected with each other, due to the action of the voltage stabilization circuit, regardless of the power generation voltage, a 3V voltage appears substantially stably at the power supply terminal plugs 215*a*, 215*b*. Thus, the electric double-layer capacitor 118 can be properly charged without being overcharged.

<Working of Electrically-Operated Car Toy According to this Embodiment>

—Charge of Car Toy—

To charge the electric double-layer capacitor 118 embedded in the car toy 1, first, the manipulation element 120*e* is appropriately manipulated to turn off the power supply switch (see FIG. 6) 120, and then the charger (the battery-type charger 2A or the hand power generation-type charger 2B) is firmly fixed through the connection between the plug on the charger side and the receptacles 117*a*, 117*b* on the toy side.

Thereafter, in the case of the battery-type charger 2A, the toy 1 completely charged to about 3V can be obtained by waiting for the state of the LED indicator lamp 207 to turn from on to off, and removing the toy 1 from the charger 2A after the LED indicator lamp goes out. Since the batteries embedded in the charger are substantially 3V, overcharge is unlikely to occur, and since the LED indicator lamp 207 does not light if the plug and the receptacles are in poor contact with each other, completion of charge is unlikely to be misunderstood. The time required for charge depends on the electrostatic capacity of the capacitor 118, and for example, charge of the capacitor 118 of about 1 to 3 F can be completed within about 10 seconds.

In the case of the hand power generation charger 2B, similarly the toy 1 is fixed on the charger 2B, and the casing 212 is held by the left hand while the hand-turned handle 213 is turned by the right-hand. Then, power is generated by the action of the embedded power generator 216 at a voltage of 3V or higher, and due to the action of the voltage stabilization IC 219 configuring the voltage stabilization circuit, an substantially 3V voltage appears between the power supply terminal plugs 215*a*, 215*b*, so that the electric double-layer capacitor 118 is charged to about 3V without being overcharged. According to the electrically-operated car toy system configured of this hand power generation-type charger 2B and the car toy 1 with the embedded electric double-layer capacitor, it is possible to realize a small and lightweight electrically-operated car toy system without using batteries. The time required for charge depends on the electrostatic capacity of the capacitor 118, and for example, charge of the capacitor 118 of about 1 to 3 F can be completed within about 15 seconds.

As already described, with the toy 1 fixed on the charger 2A or 2B, the front wheels and the rear wheels of the toy 1 are free, so that, even if charge is accidentally started while the power supply switch is on, it is unlikely that the toy 1 drops from the charger 2A or 2B due to an unexpected movement of the toy 1 through manipulation of the remote. Since the toy 1 is directly fixed on the charger 2A or 2B, the toy 1 is also advantageous in that there is no charging electric cord to drag around and that it is easy to handle and compact when stored.

—Operation of Electrically-Operated Car Toy—

Operating the electrically-operated car toy 1 requires in advance that, first, the manipulation element 120*e* is manipulated to turn the power supply switch 120 from off to on and supply the output voltage of the DC/DC converter to the transistor bridge circuit 130 of the rear-wheel rotary motor 115 which is a motive power source, and to the CPU 129 and the infrared reception IC 128 which are a control circuit.

If the infrared remote 3 is manipulated in this state, as shown in FIG. 15, the modulated infrared signal including a control command according to the contents of manipulation is sent from the infrared remote 3, and this signal is received and demodulated by the infrared reception IC 128 on the car toy 1 side, and the control command included in the demodulated electric signal is decoded and executed by the microprocessor configuring the CPU 129. As a result, the car toy 1 travels forward/backward and leftward/rightward in the designated travel mode (normal, turbo, energy saving).

During operation of the electrically-operated car toy 1, as shown in FIG. 16(*a*), the charging voltage of the electric double-layer capacitor 118 gradually decreases from the initial voltage (about 3V) in a linear manner, and at the time t1, reaches the power source voltage Vth1 (e.g., about 2.5V) required for actuation of the control circuit (the CPU 129 and the infrared reception IC 128). Even in this state, as shown in FIG. 16(*b*), since the output voltage of the DC/DC converter 20 is substantially maintained at the set retention voltage Vth4 (e.g., 3.3V), no problem occurs in actuation of the control circuit.

Thereafter, as shown in FIG. 16(*b*), the output voltage of the DC/DC converter 20 eventually undergoes a slight decrease, but is maintained at or higher than the power source voltage Vth1 required for actuation of the control circuit, until the time t2 at which the output voltage of the electric double-layer capacitor 118 applied to the input side of the DC/DC converter 20 decreases to the minimum operable voltage Vth0 (e.g., about 0.7V determined by the input threshold of the element) of the converter 20. As a result, the control circuit acts normally until the time t2, and due to the presence of the DC/DC converter 20, the travel duration time of the electrically-operated car toy 1 is extended from the time t1 to the time t2.

In fact, according to experiments of the present inventors, in which a capacitor of a small capacity of about 1 to 3 F was used as the electric double-layer capacitor 118, the travel duration time of the car toy was extended from 4 to 8 seconds (with no DC/DC converter provided) to about several tens of seconds (with the DC/DC converter provided). This confirmed that, according to the present invention, it is possible to provide an electrically-operated car toy that is small, lightweight, and inexpensive to manufacture and yet can guarantee a sufficient travel duration time per charge, and moreover has long service life since the charging element is not deteriorated by repeated charge cycles.

—Further Special Measures for Extending Travel Duration Time—

If the energy saving mode button 36 (see FIG. 15) is manipulated in the infrared remote 3 (see FIG. 15), the energy saving mode flag F is set on the car toy 1 side as shown in the flowchart of FIG. 13. Then, as shown in the flowchart of FIG. 14, the value of the output retention voltage of the DC/DC converter 20 is changed from VH to VL after waiting for the input voltage of the DC/DC converter 20 to decrease to or below the previously specified voltage Vth3. Then, as shown in the graph of FIG. 17, the value of the output voltage of the DC/DC converter 20 is switched from VH (about 3.3V) which is the initial output retention voltage, to the predetermined output retention voltage VL which is lower than VH. Due to the resulting decrease in the power source voltage to the loads, the power consumed by the loads is reduced and the voltage of the capacitor 118 is retained for a longer time, so that the travel duration time is extended from the time t2 to the time t2'.

—Measures Against Rapid Decrease of Power Source Voltage—

According to the present invention, extension of the operation duration time of the electric toy is achieved by retaining the power source voltage supplied to the load circuit for a longer time through the provision of the DC/DC converter 20. On the other hand, it was found that the power source voltage thus retained for an extended time rapidly decreases immediately before the electric charge in the electric double-layer capacitor 118 disappears. This is because, if the power source voltage rapidly decreases while the microprocessor is executing any given program, the operation of the microprocessor becomes unstable and causes an unexpected malfunction. Therefore, in this embodiment, as shown in the flowchart of FIG. 11, when the power source voltage decreases to the voltage Vth2 (see the graph of FIG. 16) which is a voltage immediately before (the time Δt before) a rapid decrease of the power source voltage, the program being executed is immediately forcibly terminated in a safe manner to thereby prevent unexpected malfunction of the microprocessor due to the following rapid decrease in the power source voltage.

—Measures for Capacitance Components on Output Side of DC/DC Converter—

According to the present invention, extension of the operation duration time of the electrically-operated toy 1 is achieved by retaining the power source voltage supplied to the load circuit for a longer time through the provision of the DC/DC converter 20. On the other hand, it was found that the capacitance components on the output side of this chopper-type step-up DC/DC converter 20 is high due to the influence of the embedded capacitor, etc. Therefore, even after the power supply switch 120 is turned off, the charging voltage may remain in the power source line on the output side of the DC/DC converter 20. This causes a major problem where the microprocessor is included in the control circuit configuring the load circuit. That is, in the microprocessor, a planned program can be normally started by actuating the built-in power-on reset function (also called a power-on clear process) upon power on. However, if the voltage of the power source line does not rise from zero volts upon power on, the power-on reset function may fail to be actuated properly. Therefore, in this embodiment, as shown in FIG. 6, when the power supply switch 120 is turned off, the positive and negative power source lines are short-circuited on the output side of the DC/DC converter 20 through the short-circuit line 121, to thereby discharge the charged electric charge and enable reliable zero-resetting of the power source line.

<Others>

In the above description, the present invention is applied to the load circuit having the control circuit. However, the present invention is of course applicable to electrically-operated movable toys as well, such as train toys travelling continuously on circular rails, that have virtually no control circuit and have a power source and a drive source simply connected through a switch. Moreover, the car toy having a control circuit is not limited to those remotely manipulated, and the present invention is also applicable to autonomous car toys that travel while detecting and avoiding obstacles on their own. Furthermore, the present invention is widely applicable to non-movable electrically-operated toys such as fixed rocking doll toys in addition to movable toys such as car, train, and airplane toys.

INDUSTRIAL APPLICABILITY

According to the electrically-operated toy of the present invention, a small and lightweight electrically-operated toy can be manufactured, and it is possible to use an electric double-layer capacitor as a main power source and yet to secure an operation duration time per charge that is long enough to fully satisfy the users who are infants, younger school children, etc.

REFERENCE SIGNS LIST

1 Electrically-operated car toy
2A Battery-type charger
2B Hand power generation-type charger
3 Infrared remote
4 Player
20 Step-up DC/DC converter
101 Left front wheel
102 Right front wheel
103 Left rear wheel
104 Right rear wheel
105 Support member of left front wheel
106 Support member of right front wheel
107 Left and right coupling rod
108 Pivot shaft of left front wheel
109 Pivot shaft of right front wheel
110 Steering magnet for left turn
111 Steering magnet for right turn

112 Steering coil for left turn
113 Steering coil for right turn
114 Rear wheel axle
115 Electric motor for travel
116 Gear train
117, 117*a*, 117*b* Power reception terminal receptacle
118 Electric double-layer capacitor
119*a*, 119*b* Charging voltage terminal of electric double-layer capacitor
120 Power switch
120*a*, 120*b*, 120*c* Terminal of power switch
120*d* Movable piece of power switch
120*e* Manipulation element of power switch
121 Short-circuit line
122 Iron-core coil
123 Step-up DC/DC converter IC
123A Step-up DC/DC converter IC
123*a* Transistor chopper
123*b*, 123*c*, 123*b*' Resistor
123*d* Reference voltage
123*e* Deviation amplifier
123*f* PWM circuit
123*g*, 123*g*' Analog switch (AS)
123*h* Inverter
124 Schottky diode
125 Electrolytic capacitor
126 Capacitor
127 Electrolytic capacitor
128 Infrared reception IC
128*a* Infrared light reception diode
128*b* Input unit
128*c* Variable gain amplification and filtration unit
128*d* Demodulation unit
128*e* Oscillation unit
128*f* Control unit
129 CPU for control
130 Transistor bridge circuit
130*a*, 130*b*, 130*c*, 130*d* Transistors configuring bridge circuit
131 Voltage detection line
201 Casing
202 Support base part
203, 203*a*, 203*b* Power supply terminal plug
204*a*, 204*b* Power source voltage terminal
205 DC power source (battery)
206 Transistor
207 LED indicator lamp
208 to 211 Resistor
212 Casing
213 Hand-turned handle
214 Support base part
215*a*, 215*b* Power supply terminal plug
216 AC power generator
217*a*, 217*b*, 217*c*, 217*d* Diode configuring full-wave rectification circuit
218 Electrolytic capacitor
219 Voltage stabilization IC
220, 221 Resistor
222 Capacitor
ΔL Clearance
Vth0 Operation limit input voltage (operation guarantee voltage) of DC/DC converter
Vth1 Operation limit voltage (operation guarantee voltage) of control circuit being a load
Vth2 Voltage immediately before rapid fall of output voltage of DC/DC converter
Vth3 Threshold voltage for determination of decrease in charging voltage of electric double-layer capacitor

The invention claimed is:

1. An electrically-operated toy, comprising:
an electric double-layer capacitor configured to serve as a main power source, rather than a battery, for the electrically-operated toy;
a movable mechanism for realizing functions to cause at least one component to move in the electrically-operated toy;
an electric motive power source for operating the movable mechanism;
a chopper step-up DC/DC converter for boosting a voltage received from the electric double-layer capacitor to generate a boosted voltage on an output of the chopper step-up DC/DC converter in order to supply the boosted voltage to at least the electric motive power source as a power source for the electric motive power source;
a power switch for turning on and off the power supply to the control circuit;
a short-circuit line that short-circuits a power line on an output side of the chopper step-up DC/DC converter when the power switch is off to thereby zero-reset a voltage applied to the control circuit; and
a control circuit for controlling an operation of the electric motive power source,
wherein the chopper step-up DC/DC converter is adapted to boost the voltage received from the electric double-layer capacitor to generate a boosted voltage on an output of the chopper step-up DC/DC converter in order to supply the boosted voltage to the control circuit as a power source to the control circuit, and
wherein the chopper step-up DC/DC converter has a constant voltage output function, and has a minimum input voltage that is lower than a first level of power source voltage required for actuation of the control circuit, and a constant output voltage that is higher than the first level of power source voltage required for actuation of the control circuit.

2. An electrically-operated toy, comprising:
an electric double-layer capacitor configured to serve as a main power source, rather than a battery, for the electrically-operated toy;
a movable mechanism for realizing functions to cause at least one component to move in the electrically-operated toy;
an electric motive power source for operating the movable mechanism;
a chopper step-up DC/DC converter for boosting a voltage received from the electric double-layer capacitor to generate a boosted voltage on an output of the chopper step-up DC/DC converter in order to supply the boosted voltage to at least the electric motive power source as a power source for the electric motive power source; and
a control circuit for controlling an operation of the electric motive power source,
wherein the chopper step-up DC/DC converter is adapted to boost the voltage received from the electric double-layer capacitor to generate a boosted voltage on an output of the chopper step-up DC/DC converter in order to supply the boosted voltage to the control circuit as a power source to the control circuit, wherein the chopper step-up DC/DC converter has a constant voltage output function, and has a minimum input voltage that is lower than a first level of power source voltage required for actuation of the control circuit, and a constant output voltage that is higher than the first level of power source voltage required for actuation of the control circuit, wherein the control circuit includes a microprocessor serving as a CPU, and wherein the microprocessor has a built-in function of forcibly terminating program execution upon detecting that the output voltage of the chopper step-up DC/DC converter has fallen to a predetermined voltage that is preset as a value immediately before a rapid fall toward zero volts.

3. The electrically-operated toy according to claim 2, wherein the microprocessor has a built-in function of detecting a charging voltage of the electric double-layer capacitor and changing a set output voltage value of the chopper step-up DC/DC converter according to the detected value of the charging voltage.

4. The electrically-operated toy according to claim 2, wherein the movable mechanism includes both components of a front-wheel steering mechanism and a rear-wheel rotating mechanism for serving as car toy functions, wherein the electric motive power source is a steering drive source for operating the front-wheel steering mechanism and a rear-wheel electric motor for operating the rear-wheel rotating mechanism, and wherein the control circuit has a function of controlling the steering drive source and the rear-wheel electric motor according to a first control command.

5. The electrically-operated toy according to claim 4, wherein the microprocessor has at least built-in functions of power-on reset and of controlling at least the steering drive source and the rear-wheel electric motor by decoding and executing a given control command, and the electrically-operated toy further includes:

a power switch for turning on and off the power supply to the control circuit; and a short-circuit line that short-circuits an electric power supply line on a secondary side of the chopper step-up DC/DC converter when the power switch is off to thereby zero-reset the voltage applied to the control circuit.

6. The electrically-operated toy according to claim 5, wherein the microprocessor further has a built-in function of detecting a charging voltage of the electric double-layer capacitor and changing a set output voltage value of the chopper step-up DC/DC converter according to the detected value of the charging voltage.

7. The electrically-operated toy according to claim 5, wherein the microprocessor further has built-in functions of setting a current flowing through the rear-wheel electric motor by applying a voltage pulse train to the rear-wheel electric motor, and of reducing the current flowing through the rear-wheel electric motor by changing a pulse width, pulse frequency, and/or duty ratio of the pulse train when the first control command is an energy saving command.

8. The electrically-operated toy according to claim 5, wherein the control circuit further includes a reception demodulation IC that is configured to receive and demodulate a control command wirelessly sent by a predetermined modulation method and gives the first control command to the microprocessor, and the microprocessor is configured to receive the first control command wirelessly sent from a predetermined remote controller through the reception demodulation IC, and to decode and execute the first control command.

9. The electrically-operated toy according to claim 2, further comprising:

a charger that is configured to be attached to and detached from the electrically-operated toy and configured to charge the electric double-layer capacitor embedded in the electrically-operated toy.

10. The electrically-operated toy according to claim 9, the charger including:

a pair of power supply terminals connected with a pair of power reception terminals on an electrically-operated toy side;

a charging power source unit being composed of one or more batteries and having an output voltage that is set to be substantially equal to a target charging voltage;

a resistor being placed on an electrical path leading from the charging power source unit to the power supply terminals and limiting a charging current flowing into the electric double-layer capacitor; and an indicator lamp configured to light only i) during a period in which there is electrical continuity between the pair of power supply terminals and the pair of power reception terminals and ii) when at the same time a voltage across the pair of power supply terminals has risen to the target charging voltage.

11. The electrically-operated toy according to claim 9, the charger including:

a pair of power supply terminals connected with a pair of power reception terminals on the electrically-operated toy side;

a charging power source being composed of a manual power generator outputting a DC voltage; and a smoothing and stabilizing circuit smoothing a voltage obtained from the charging power source unit and stabilizing the voltage to a target charging voltage.

12. The electrically-operated toy according to claim 4, further comprising:

a charger that is configured to be attached to and detached from the electrically-operated toy and is configured to charge the electric double-layer capacitor embedded in the electrically-operated toy.

13. The electrically-operated toy according to claim 12, the charger including:

pair of power supply terminals connected with a pair of power reception terminals on the side of a car toy constituting the electrically-operated toy;

a charging power source unit being composed of one or more batteries and having an output voltage that is set to be substantially equal to a target charging voltage;

resistor being placed on an electrical path leading from the charging power source unit to the power supply terminals and limiting the charging current flowing into the electric double-layer capacitor; and an indicator lamp configured to light only i) during a period in which there is electrical continuity between the pair of power supply terminals and the pair of power reception terminals and ii) when at the same time a voltage across the pair of power supply terminals has risen to the target charging voltage, wherein the pair of power supply terminals is configured as a power supply terminal receptacle or a power supply terminal plug that is provided on an external surface of a casing of a hand-held charger and that is plug-connected with a pair of power reception terminal plugs or power reception terminal receptacles provided on a bottom of a car body of the car toy in a state where rear wheels of the car toy are lifted.

14. The electrically-operated toy according to claim 12, wherein the charger further includes a pair of power supply terminals to be connected with a pair of power reception terminals on an electrically-operated toy side;

a charging power source unit being composed of a manual power generator outputting a DC voltage; and a smoothing and stabilizing circuit smoothing a voltage obtained from the charging power source unit and stabilizing the voltage obtained from the charging power source unit to a target charging voltage, wherein the pair of power supply terminals is configured as a power supply terminal receptacle or a power supply terminal plug that is provided on an external surface of a casing of a hand-held charger and that is plug-connected with a pair of power reception terminal plugs or power reception terminal receptacles provided on the bottom of the car body of the car toy in a state where the rear wheels of the car toy are lifted.

15. An electrically-operated toy that includes a non-transitory machine readable medium to store a computer program in an executable format for the electrically-operated toy that includes:

an electric double-layer capacitor configured to serve as a main power source, rather than a battery, for the electrically-operated toy;

a movable mechanism for realizing functions to cause at least one component to move in the electrically-operated toy;

an electric motive power source for operating the movable mechanism;

a control circuit for controlling an operation of the electric motive power source; and a chopper step-up DC/DC converter for boosting a voltage received from the electric double-layer capacitor to generate a boosted voltage on an output of the chopper step-up DC/DC converter in order to supply the boosted voltage to at least the control circuit as a power source for the control circuit, wherein the computer program is configured to cause a microprocessor included in the control circuit to function so as to forcibly terminate program execution upon detecting that an output voltage of the chopper step-up DC/DC converter has fallen to a predetermined voltage that is preset as a value immediately before a rapid fall to zero volts.

* * * * *